US011904380B2

(12) United States Patent
Eicher

(10) Patent No.: US 11,904,380 B2
(45) Date of Patent: Feb. 20, 2024

(54) METHOD FOR PRODUCING HELICES, PRODUCTION DEVICE FOR PRODUCING HELICES, CHAIN-LINK NET DEVICE, AND USES OF THE CHAIN-LINK NET DEVICE

(71) Applicant: Geobrugg AG, Romanshorn (CH)

(72) Inventor: Manuel Eicher, Winden (CH)

(73) Assignee: Geobrugg AG, Romanshorn (CH)

( * ) Notice: Subject to any disclaimer, the term of this patent is extended or adjusted under 35 U.S.C. 154(b) by 219 days.

(21) Appl. No.: 17/425,911

(22) PCT Filed: Jan. 31, 2020

(86) PCT No.: PCT/EP2020/052406
§ 371 (c)(1),
(2) Date: Jul. 26, 2021

(87) PCT Pub. No.: WO2020/157267
PCT Pub. Date: Aug. 6, 2020

(65) Prior Publication Data

US 2022/0161311 A1 May 26, 2022

(30) Foreign Application Priority Data

Feb. 1, 2019 (DE) ..... 10 2019 102 593.1

(51) Int. Cl.
*B21F 15/04* (2006.01)
*B21F 27/04* (2006.01)
(Continued)

(52) U.S. Cl.
CPC ..... *B21F 15/04* (2013.01); *B21F 27/04* (2013.01); *E01F 7/045* (2013.01); *E04H 17/05* (2021.01)

(58) Field of Classification Search
CPC ..... E04H 17/02; E04H 17/04; E04H 17/05; E04H 17/06; B21F 27/00; B21F 27/005; B21F 27/02; B21F 27/04
See application file for complete search history.

(56) References Cited

U.S. PATENT DOCUMENTS 1,691,507 A * 11/1928 Anderson ..... B21F 27/005 245/10
1,803,144 A * 4/1931 Pink ..... B21F 27/005 198/848
(Continued)

FOREIGN PATENT DOCUMENTS

CH 706 178 B1 2/2016
CN 208131885 U 11/2018
(Continued)

OTHER PUBLICATIONS

Examination Report dated Mar. 2, 2022 issued in corresponding IN patent application No. 202117034390.
(Continued)

*Primary Examiner* — Jonathan P Masinick
(74) *Attorney, Agent, or Firm* — POSZ LAW GROUP, PLC

(57) ABSTRACT

A method for producing helices for a chain-link net, said helices for forming the chain-link net being interconnected, and rotated into one another, wherein the helices are produced from at least one longitudinal element, in particular a single wire, a wire bundle, a wire strand, and/or a wire rope, with at least one wire being partially implemented from a high-tensile steel, and wherein the helices are bent so that they include a plurality of first legs, a plurality of second legs, and a plurality of bending regions that interconnect a first leg and a neighboring second leg, wherein the helices are bent, by a braiding knife assembly comprising at least one braiding knife, in such a manner that at least the center
(Continued)

points of the first legs and/or at least the center points of the second legs of a completely bent helix each lie substantially in one plane respectively.

9 Claims, 9 Drawing Sheets

(51) Int. Cl.
*E01F 7/04* (2006.01)
*E04H 17/04* (2006.01)

(56) References Cited

U.S. PATENT DOCUMENTS

| | | | | |
|---|---|---|---|---|
| 1,995,222 | A * | 3/1935 | Pink | B21F 27/005 245/6 |
| 2,292,663 | A * | 8/1942 | Otto | F16K 11/074 198/848 |
| 4,049,224 | A * | 9/1977 | Wener | B21F 33/002 140/3 R |
| 4,114,860 | A * | 9/1978 | Parisien | E04H 17/124 248/200 |
| 8,616,079 | B2 | 12/2013 | Nozaki et al. | |
| 9,333,553 | B2 * | 5/2016 | Wartmann | B21F 27/02 |
| 9,452,467 | B2 * | 9/2016 | Atz | A01K 75/00 |
| 10,058,909 | B2 * | 8/2018 | Wendeler-Goeggelmann | B21F 27/04 |
| 10,145,045 | B2 * | 12/2018 | Wendeler-Goeggelmann | E01F 7/04 |
| 10,544,552 | B2 * | 1/2020 | Wendeler-Goeggelmann | E01F 7/045 |
| 10,549,335 | B2 * | 2/2020 | Wendeler-Goeggelmann | B21F 27/02 |
| 10,597,833 | B2 * | 3/2020 | Wendeler-Goeggelmann | E01F 7/045 |
| 10,857,588 | B2 * | 12/2020 | Wendeler-Goeggelmann | B21F 27/04 |
| 2012/0241565 | A1 | 9/2012 | Wartmann | |
| 2015/0041599 | A1 | 2/2015 | Wartmann | |
| 2018/0214929 | A1 | 8/2018 | Wendeler-Goeggelmann | |
| 2019/0321877 | A1 * | 10/2019 | Wendeler-Goeggelmann | E01F 7/04 |
| 2019/0381558 | A1 | 12/2019 | Wendeler-Goeggelmann | |

FOREIGN PATENT DOCUMENTS

| | | | | |
|---|---|---|---|---|
| DE | 346263 | C | * 12/1921 | |
| DE | 423709 | C | 1/1926 | |
| DE | 629040 | C | 4/1936 | |
| DE | 1 160 396 | | 1/1964 | |
| DE | 2 327 005 | | 12/1974 | |
| DE | 102010022956 | A1 | * 12/2011 | E04H 17/06 |
| DE | 10 2017 101 754 | B3 | 5/2018 | |
| DE | 10 2017 101 759 | B3 | 6/2018 | |
| DE | 10 2017 101 751 | B3 | 7/2018 | |
| GB | 939309 | | 10/1963 | |
| JP | 5035475 | B2 | 7/2012 | |
| RU | 2 376 097 | C2 | 12/2009 | |
| RU | 2 530 799 | C1 | 10/2014 | |
| WO | 2009/086961 | A1 | 7/2009 | |

OTHER PUBLICATIONS

Examination Report dated Mar. 31, 2022 issued in corresponding RU patent application No. 2021 125 104 ( and machine translation attached).

Japanese Office Action dated Jul. 5, 2022 in corresponding Japanese Patent Application No. JP 2021-544437 (and English machine translation).

Canadian Examination Report dated Jul. 20, 2022 in corresponding Canadian Patent Application No. CA 3,128,088.

Australian Examination Report dated Jul. 29, 2022 in corresponding Australian Patent Application No. AU 2020213696.

Indonesian Office Action dated Aug. 8, 2022 in corresponding Indonesian Patent Application No. ID P00202106683 (and English Translation).

German Search Report dated Nov. 14, 2019 issued in corresponding DE Application No. DE 10 2019 102 593.1 (and English translation).

International Preliminary Report on Patentability of Patent Cooperation Treaty dated Jul. 27, 2021 issued in corresponding PCT/EP2020/052406.

GCC Office Action dated Jun. 3, 2021 issued in corresponding GCC Application No. 2020/39089.

Pakistani Examination Report dated Apr. 16, 2021 issued in corresponding PK Application No. PK 76/2020.

Chinese Office Action dated Feb. 28, 2023 issued in corresponding Chinese Application No. 202080011793.0 (and English machine translation).

Canadian Office Action dated Mar. 24, 2023 issued in corresponding Canadian Application No. 3,128,088.

Austrian Search Report dated Aug. 22, 2022 issued in corresponding Austrian Application No. GM 11/2020.

Chilean Office Action dated Sep. 14, 2022 issued in corresponding Chilean Application No. 1995-2021 (and English Machine Translation).

International Search Report of the International Searching Authority dated May 20, 2020 for the corresponding international application No. PCT/EP2020/052406 (and English translation).

Taiwanese Office Action dated Oct. 28, 2020, issued in corresponding TW Patent Application No. 109101861 (and English Machine Translation).

* cited by examiner

METHOD FOR PRODUCING HELICES, PRODUCTION DEVICE FOR PRODUCING HELICES, CHAIN-LINK NET DEVICE, AND USES OF THE CHAIN-LINK NET DEVICE

CROSS REFERENCE TO RELATED APPLICATIONS

This application is a U.S. national stage application of PCT/EP2020/052406 filed on Jan. 31, 2020, which is based on German Patent Application No. 10 2019 102 593.1 filed on Feb. 1, 2019, the contents of which are incorporated herein by reference.

PRIOR ART

The invention relates to a method for producing helices, according to the preamble of claim 1; to a production device for producing helices, according to the preamble of claim 13; to a chain-link net device according to the preamble of claim 42; and to uses of the chain-link net device, according to claims 53 and 54.

A method for producing helices for a chain-link net, said helices for forming the chain-link net being configured for being interconnected, wherein the helices are produced from at least one longitudinal element having at least one wire that is at least partially made of a high-tensile steel, and wherein the helices are bent in such a manner that said helices comprise at least a plurality of first legs, at least a plurality of second legs, as well as at least a plurality of bending regions that interconnect a first leg and a neighboring second leg has already been proposed.

The object of the invention lies in particular in providing a particularly suitable production method as well as a particularly suitable production device for helices of chain-link nets, having particularly advantageous net properties as are described in particular hereunder. The object is achieved according to the invention by the features of Patent claims 1, 13, and 42, while advantageous design embodiments and refinements of the invention can be derived from the dependent claims.

Advantages of the Invention

The invention proceeds from a method for producing helices for a chain-link net, said helices for forming the chain-link net being configured for being interconnected, in particular being rotated into one another, wherein the helices are produced from at least one longitudinal element, in particular a single wire, a wire bundle, a wire strand, and/or a wire rope, with at least one wire that is at least partially made of a high-tensile steel, and wherein the helices are bent in such a manner that they comprise at least a plurality of first legs, at least a plurality of second legs, as well as at least a plurality of bending regions that interconnect a first leg and a neighboring second leg.

It is proposed that the helices are bent, by a braiding knife assembly that has at least one braiding knife, in such a manner that at least the center points of the first legs and/or at least the center points of the second legs of a completely bent helix each lie at least substantially in one plane respectively. The first legs and/or the second legs of the helix completely bent by means of the method preferably respectively lie at least largely or completely in the plane. On account thereof, a particularly suitable method for the production of helices of chain-link nets having particularly advantageous net properties can be advantageously achieved. On account thereof, planar helices that are composed of high-tensile steel can be advantageously produced by means of the braiding knife assemblies. In particular, planar helices for a chain-link net that are at least partially made of high-tensile steel can advantageously be rendered so as to be producible by means of a braiding knife assembly. On account thereof, an already known production device can advantageously be conceived for use with high-tensile steel by means of simple modifications. In particular, a particularly simple and/or particularly effective production method can be achieved on account thereof. In particular, the center points of legs of helices from high-tensile steel that are bent by conventional braiding knives do not lie in one plane but on account of the rebounding effects of the high-tensile steel are respectively rotated by an angle out of the plane. Comparisons to this end are in particular also in FIG. 12*b* in which such a non-rectified helix is illustrated. An influence of said rebounding effect is advantageously considered in the present braiding knife assembly such that planar flat helices from high-tensile steel can be advantageously produced on account thereof.

A "helix" is in particular to be understood to be a wire helix. The helix has in particular a shape of a preferably flat helicoid. The helix has in particular a shape of a flat helix. The helix implements in particular a helix that is at least partially compressed so as to be flat which in a view along a longitudinal direction of the helix realizes a substantially elliptic shape and/or a shape of a stadium running track (corresponding to two semicircles connected by two straight lines). A "chain-link net" is in particular to be understood to be a net which is implemented from bent longitudinal elements, wherein neighboring longitudinal elements are in particular interconnected by mutual engagement. In particular, interconnected helices in a spread-out state of the chain-link net contact one another at the bending regions thereof, wherein neighboring bending regions in an alternating manner contact in particular neighboring helices. In particular, every other bending region contacts the same neighboring helix. The interconnected longitudinal elements herein preferably implement at least partially angular, preferably square, or at least partially round meshes. The chain-link net in a direction that is perpendicular to a net plane of the chain-link net preferably has an extent which is substantially larger, preferably at least three times larger, preferably at least five times larger, than a mean diameter of a longitudinal element of the chain-link net. In particular, a chain-link net has at least one preferred direction of elongation. A square chain-link net, for example, along connecting lines of opposite corners of the square chain-link net advantageously has two, in particular equitable, preferred directions of elongation.

In particular, a longitudinal element has a longitudinal extent which is at least 10 times, preferably at least 50 times, and preferably at least 100 times the size of a maximum transverse extent running perpendicularly to the longitudinal extent. In particular, at least one of the helical longitudinal elements, preferably all helical longitudinal elements, is/are produced from at least a single wire, a wire bundle, a wire strand, a wire rope, and/or any other longitudinal element having at least one wire. A "wire" in this context is in particular to be understood to be an elongate and/or thin and/or a flexural member, and/or a member that is capable of being bent by a machine. The wire along the longitudinal direction thereof advantageously has an at least substantially constant, in particular circular or elliptic, cross section. The wire is particularly advantageously embodied as a round wire. However, it is also conceivable for the wire, at least section-wise or completely, to be implemented as a flat wire, a square wire, a polygonal wire, and/or a profiled wire. A "high-tensile" steel is in particular to be understood to be a steel having a tensile strength of more than 1000 N/mm$^2$, spring steel, and/or carbon steel. An "at least partial implementation from high-tensile steel" is in particular to mean that the wire, except for coatings or sheathings, is made of high-tensile steel. In particular, a high-tensile steel has a greater rebound, that is to say a lower rebound factor, in comparison to non-high-tensile steel. In particular, the value of the rebound factor of the longitudinal element is less than 0.95, preferably less than 0.92, preferably less than 0.90, and particularly preferably less than 0.85.

The first leg of the helix and/or the second leg of the helix, particularly in a first view perpendicular to a plane of main extent of the helix, runs/run at least at a first pitch angle in relation to a longitudinal direction of the helix, wherein the first pitch angle preferably has a value of approximately 45°. The bending region, in particular in the first view perpendicular to the plane of main extent of the helix, has an opening angle of approximately 90°. The bending region, in particular in a second view parallel with the plane of main extent of the helix and perpendicular to the longitudinal direction of the helix, at least in a sub-region of the helix has a stepped or an S-shaped profile. The bending region, in particular in a third view parallel with the plane of main extent of the helix and parallel with the longitudinal direction of the helix, has a bending angle of approximately 180° or less. Neighboring legs of the helix that are connected by a bending region preferably run on planes that are free of any mutual overlap and/or within volumes that are free of any mutual overlap. A "plane of main extent" of a functional unit is in particular to be understood as a plane which is parallel with a largest lateral face of a smallest imaginary cuboid that just completely envelops the functional unit, and which in particular runs through the center point of the cuboid.

A "center point of a leg" is in particular to be understood as a point of a leg which lies precisely in the center between two bending regions that delimit the leg. It is conceivable for all first legs of the completely bent helix to run at least in a first plane, or for all first legs to contact the first plane by way of at least substantially identical leg sections. It is conceivable for all second legs of the completely bent helix to run at least in a second plane, or for all second legs to contact the second plane by way of at least substantially identical leg sections. In particular, the first plane and the second plane run so as to be mutually parallel. The first legs of the helix, in particular in a view of the helix along the longitudinal direction of the helix, overlap at least substantially, preferably completely. The second legs of the helix, in particular in a view of the helix along the longitudinal direction of the helix, overlap at least substantially, preferably completely. Two legs "overlapping at least substantially" is in particular to be understood that at least 80%, preferably at least 90%, and preferably at least 95%, of a leg is covered by another leg when viewed in the chosen direction. Two center points of legs lying "substantially in one plane" is in particular to be understood that the points from a common plane have a maximum spacing which is smaller than two mean diameters of the longitudinal element, preferably smaller than a mean diameter of the longitudinal element, and preferably at most 50% of a mean diameter of the longitudinal element. The braiding knife, in particular with the exception of the twisted features, is in particular realized as a flat, preferably elongate element, preferably a metal element, the longitudinal extent thereof preferably being at least twice, preferably at least five times, a maximum transverse extent. The braiding knife assembly, besides the braiding knife, comprises in particular at least one braiding worm, at least one holding unit for mounting at least the braiding knife and/or at least the braiding worm, and at least one drive unit for driving at least the braiding knife in a rotating manner. The braiding knife assembly preferably has the usual components of a wire bending machine having a braiding knife and a braiding worm, as well as a usual mutual arrangement of the components of the wire bending machine (for example the arrangement of the braiding knife within the braiding worm). "Largely" is in particular to be understood at least 51%, preferably at least 66%, advantageously at least 80%, preferably at least 90%, and particularly preferably at least 95%.

A chain-link net having particularly advantageous net properties, in particular a particularly high stability, can advantageously be achieved when the wire has a tensile strength of at least 1370 N/mm$^2$, preferably at least 1770 N/mm$^2$, and preferably at least 2200 N/mm$^2$.

A chain-link net having particularly advantageous net properties, in particular particularly advantageous elongation properties, can moreover be advantageously achieved when the helices are bent in such a manner that a chain-link net which, in a frontal view perpendicular to a plane of main extent of the helices realizes an at least substantially square mesh shape, is formed by a plurality of helices being connected, in particular by a plurality of helices being rotated into one another. A square chain-link net of the present type, that is to say in particular a three-dimensional square chain-link net, has in particular two equitable and mutually perpendicular preferred directions of elongation. On account thereof, for example when installing the square chain-link net in a situation in which a direction of elongation cannot be readily predicted, for example when installing the square chain-link net in a ceiling of an underground mine, an improved absorption of energy can be achieved in the retention of material that impacts the square chain-link net. Moreover, an assembly speed can advantageously be increased, since an alignment of the square chain-link net can be dispensed with.

It is furthermore proposed that, in particular in at least one method step, the helices are bent by the braiding knife assembly in such a manner that a rebound of the wire of the helices, in particular elastic deformation of the wire of the helices that is at least partially implemented of a high-tensile steel is at least substantially compensated for at least in a direction transverse to the longitudinal direction of the helices. On account thereof, a particularly suitable method for producing helices of chain-link nets having particularly advantageous net properties can advantageously be achieved. Planar helices composed of high-tensile steel can advantageously be bent on account thereof. On account thereof, the planar helices composed of high-tensile steel can advantageously be produced by means of the braiding knife assembly. When the rebound is substantially compensated for, the wire is preferably bent in such a manner that the wire upon rebounding of the wire assumes an envisaged bending position. "Substantially compensated for" is in particular to be understood to be compensated for by at least 80%, preferably by at least 90%, and preferably by at least 95%.

It is moreover proposed that the helices, in particular the bending regions of the helices, in particular in at least one method step, are overbent, in particular over-rotated, by the braiding knife assembly at least in a direction transverse to the longitudinal direction of the helices. On account thereof, a particularly suitable method for producing helices of chain-link nets having particularly advantageous net properties can advantageously be achieved. Planar helices composed of high-tensile steel can advantageously be bent on account thereof. In particular, rebounding of the high-tensile steel can advantageously be compensated for. "Overplying" a helix is in particular to be understood to be a counterrotation of neighboring legs of bending regions of the helix in a direction transverse to the longitudinal direction of the helix, this when "releasing" the helix leading to rebounding of the helix in the direction transverse to the longitudinal direction, wherein the legs of the helix upon rebounding preferably at least substantially overlap when viewed along the longitudinal direction.

It is additionally proposed that the helices, in particular the bending regions of the helices, in particular in at least one method step, by the braiding knife assembly are overbent, in particular overcompressed, at least in a direction parallel with the longitudinal direction of the helices. On account thereof, a particularly suitable method for producing helices of chain-link nets having particularly advantageous net properties can be advantageously achieved. Helices which are composed of high-tensile steel and which at the bending regions are provided with a precisely adjustable opening angle can advantageously be produced on account thereof, wherein the opening angle is the angle of the bending region when viewed perpendicularly to the plane of main extent of a helix. Helices which are composed of high-tensile steel and which have an opening angle of approximately 90° can advantageously be produced on account thereof. In particular, rebounding of the high-tensile steel can advantageously be compensated for. The longitudinal direction of a helix corresponds in particular to a direction of main extent of the helix. A "direction of main extent" of an object here in is in particular to be understood to be a direction which runs parallel with a longest edge of a smallest geometric cuboid which just completely envelops the object. "Overcompressing" a helix is in particular to be understood to be compressing the bending regions of the helix in a longitudinal direction of the helix, this when "releasing" the helix leading to the helix rebounding in the longitudinal direction, wherein the helix upon rebounding preferably assumes the desired opening angle.

It is furthermore proposed that the helices, in particular in each bending region of the helices, in the longitudinal direction of the helices and/or transverse to the longitudinal direction of the helices are overbent by an overbending angle of at least 20°, preferably at least 30°, preferably at least 40°, and particularly preferably of at least 50°. On account thereof, a particularly suitable method for producing helices of chain-link nets having particularly advantageous net properties can advantageously be achieved. Planar helices, and/or helices which at the bending region are provided with a precisely adjustable opening angle and which are composed of various high-tensile steels and/or which have various wire diameters can advantageously be produced on account thereof. In particular, an overbending angle by which a bending region of a helix has to be overbent so as to achieve a desired final angle is in particular a function of the tensile strength of the steel used, and of the wire diameter of the wire used. In particular, a required overbending angle increases with an increasing tensile strength and/or an increasing wire diameter.

A particularly efficient, preferably interruption-free, production method for planar helices from high-tensile steel by means of a braiding knife assembly can be advantageously achieved when, at least in a first method step, the rebound is at least partially compensated for by the braiding knife and/or the helices can be overbent by the braiding knife. In particular, the longitudinal element when compensating the rebound by way of the braiding knife is wound around the braiding knife in such a manner that overbending of the longitudinal element arises already in the winding around the braiding knife and/or when sliding across the length of the braiding knife, for example in that the braiding knife is implemented so as to be inherently twisted and/or in that the braiding knife has a dumbbell-shaped cross section which permits overbending of the longitudinal element, or into the concave clearance of which the longitudinal element that is wound on the braiding knife can be pushed into, respectively.

Moreover, a particularly efficient, preferably interruption-free, production method for helices from high-tensile steel having a precisely adjustable opening angle (in a view perpendicular to the plane of main extent of a helix), for example an opening angle of approximately 90°, can be advantageously achieved by means of a braiding knife assembly when the rebound is at least partially compensated for by a braiding worm of the braiding knife assembly, and/or the helices are overbent by the braiding worm of the braiding knife assembly. When compensating the rebound by way of the braiding worm, the longitudinal element is in particular guided in a worm thread turn of the braiding worm in such a manner that overbending of the longitudinal element in the longitudinal direction arises already in the guiding in the braiding worm and/or when passing the length of the worm thread turn of the braiding worm, for example in that the worm thread turn of the braiding worm has a flatter turn pitch than the desired helix, and/or in that the worm thread turn has a turn pitch that increases toward an outlet of the braiding knife assembly. Alternatively or additionally, it is conceivable that the turn pitch of the worm thread turn of the braiding worm is capable of being manipulated for overbending, in particular that the worm thread turn of the braiding worm can be compressed or expanded during a bending procedure.

It is additionally proposed that the rebound is at least partially compensated for by a rectifying unit of the braiding knife assembly that is downstream of the braiding knife, and/or the helices are overbent by the rectifying unit of the braiding knife assembly that is downstream of the braiding knife. On account thereof, a particularly efficient, preferably interruption-free, production method for helices from high-tensile steel having a precisely adjustable opening angle and/or for planar helices from high-tensile steel can advantageously be achieved. In particular, the downstream rectifying unit is disposed in an end region of the braiding knife and/or of the braiding worm, the longitudinal element exiting the braiding knife in said end region, and/or in a proximal region of the end region. A "proximal region" is in particular to be understood to be a region which is completely formed from points which from an outlet-side end edge of the braiding knife have a maximal spacing of 2 m, preferably of 1 m, and preferably of 0.5 m. The rectifying unit being "downstream" is in particular to be understood that rectifying, in particular planar rectifying, of the rectifying unit is performed after a completed bending procedure of the braiding knife/braiding worm combination. "Planar rectifying" of a helix is in particular to be understood as bringing the legs of the helix so as to overlap in the longitudinal direction of the helix.

It is furthermore proposed that, for a rectifying of the helices, the helices bent by the braiding knife are additionally elongated, in particular overelongated, parallel with the longitudinal direction of the helices, are additionally compressed, in particular overcompressed, parallel with the longitudinal direction of the helices, and/or are rotated, in particular over-rotated, transversely to the longitudinal direction of the helices. A simple and/or precise setting of a helix geometry of a helix from high-tensile steel can advantageously be achieved on account thereof. On account thereof, helices which are composed of high-tensile steel and which are planar and/or implement square meshes can advantageously be produced by means of the braiding knife assemblies. In particular, the downstream rectifying unit has at least two rectifying elements which are mounted so as to be movable in relation to one another and which are configured for elongating, in particular overelongating, for compressing, in particular overcompressing, and/or plying, in particular overplying, sub-regions of the helices in relation to one another. To this end, two mutually spaced-apart parts of a helix, for example two neighboring legs or two end regions of the helix, are in particular firmly held by the rectifying elements, and the rectifying elements are subsequently moved towards one another in an opposing manner. It is conceivable for the rectifying unit to have more than two rectifying elements that are movable in a mutually independent manner.

When during the bending procedure the respective helix bearing on the braiding knife is pressed onto the braiding knife at least in a transition region between a bending region and a first leg that adjoins the bending region, as well as at least in a further transition region between the bending region and a second leg that adjoins the bending region, at least partial rectifying, in particular planar rectifying, of the helix can advantageously be enabled. Particularly simple and/or precise rectifying of helices from high-tensile steel can advantageously be enabled on account thereof. On account thereof, planar helices which are composed of high-tensile steel can advantageously be produced by means of the braiding knife assemblies. Alternatively or additionally, the entire legs can be pressed onto the braiding knife. The entire legs herein are in particular pressed against an external geometry of the braiding knife that corresponds to a cross section of the braiding knife. For example, when the braiding knife has a concave clearance, overpressing can be achieved in this way, in particular in that the legs are at least partially pressed into the concave clearance. Depending on the external geometry of the braiding knife, further leg geometries of the helices can moreover also be achieved by pressing the legs against the braiding knife, such as, for example, undulated legs or legs that are curved in a bulging manner. The pressing of the helices in the transition regions is preferably performed by means of pressing elements which compress the transition regions of the helix by means of a kind of pincer grip. In particular, the rotating movement of the braiding knife continues in an interruption-free manner when said pressing is carried out. Alternatively, the rotating movement of the braiding knife is briefly stopped when said pressing is carried out.

Moreover proposed is a production device for producing helices for a chain-link net, said production device having the braiding knife assembly having at least the braiding knife. On account thereof, a particularly simple and/or particularly suitable production device for producing helices of chain-link nets having particularly advantageous net properties can advantageously be achieved. On account thereof, planar helices which are composed of high-tensile steel can advantageously be produced by means of the braiding knife assemblies. The braiding knife is in particular implemented as an elongate flat material, for example an elongate flat steel. For implementing the helix, an unprocessed longitudinal element is wound in a helical manner around the braiding knife while constantly infeeding the as yet unbent portion of the unprocessed longitudinal element. The longitudinal element herein, in a view along the longitudinal direction, with the exception of rebounds, assumes a profile which substantially follows an external shape of the braiding knife. It is conceivable for the braiding knife assembly to be conceived for simultaneously bending two longitudinal elements so as to form respectively one helix. A production rate can advantageously be further increased on account thereof.

It is moreover proposed that the production device has a rectifying unit which is configured for a rectifying of a helix in such a manner, in particular in a planar manner, that at least the center points of the first leg and/or at least the center points of the second leg of a completely bent, in particular bulging, helix lie at least substantially in one plane. The first legs and/or the second legs of the helix completely bent by the production device preferably respectively lie at least largely or completely in the plane. On account thereof, a particularly suitable production device for producing helices of chain-link nets having particularly advantageous net properties can advantageously be achieved. On account thereof, planar helices made of high-tensile steel are advantageously producible by means of the braiding knife assemblies. In particular, the rectifying unit is configured for rectifying in a planar manner helices of which neighboring legs without rectifying by means of the rectifying unit, when viewed parallel to the longitudinal direction of the helices, would be respectively rotated into one another by an angle which is in particular clearly identifiable and in particular is larger than 3°. The rectifying unit is in particular configured for precluding that the directions of main extent of neighboring legs of one helix are at a mutual angle. The rectifying unit is in particular configured for rectifying neighboring legs of one helix in such a manner that the directions of main extent of the legs of the helix lie in one common plane.

Planar helices can be rendered so as to be advantageously producible from high-tensile steel while using braiding knives when the rectifying unit is configured for overbending helices, in particular in the bending regions of the latter. The rectifying unit for overbending a bending region is conceived for bending towards one another at least part of the legs connected to the bending region in the longitudinal direction of the helix and/or perpendicularly to the longitudinal direction of the helix, wherein an actual bending angle is in particular substantially larger than an angle of the bend which the completely bent helix finally comprises.

It is furthermore proposed that the rectifying unit is at least partially implemented integrally with the braiding knife. A particularly advantageous implementation of the rectifying unit can be achieved on account thereof. A rectifying unit of this type has in particular an advantageously low level of complexity. For an implementation of the rectifying unit, the braiding knife is in particular shaped in such a manner that helices are at least partially rectified, in particular rectified in a planar manner, already when sliding across the braiding knife during a winding procedure.

It is furthermore proposed that the rectifying unit is at least partially implemented integrally with a braiding worm of the braiding knife assembly. A particularly advantageous implementation of the rectifying unit can be achieved on account thereof. A rectifying unit of this type has in particular an advantageously low level of complexity. The braiding worm has in particular at least one worm thread turn which during the bending procedure for bending a helix is at least configured for implementing a guide gate for guiding the longitudinal element along the braiding knife. It is additionally conceivable for the braiding worm to have a further worm thread turn which implements a further guide gate, on account of which simultaneous bending of two helices in the braiding knife assembly can advantageously be enabled. For an implementation of the rectifying unit, the braiding worm, in particular the worm thread turn of the braiding worm, is in particular shaped in such a manner that helices, in particular bending regions of helices, are at least partially rectified, in particular elongated or compressed, in particular along the longitudinal direction of the helices, already when passing through the worm thread turn of the braiding worm during a winding procedure.

It is furthermore proposed that the rectifying unit is at least partially disposed so as to be downstream of the braiding knife and/or of a braiding worm of the braiding knife assembly. Particularly precise rectifying of helices can advantageously be enabled on account thereof. In particular, the rectifying unit can at the same time be partly implemented integrally with the braiding knife, partly implemented integrally with the braiding worm, and/or be partly disposed so as to be downstream of the braiding knife assembly. "Integral" herein is in particular to be understood as being connected in at least a materially integral manner, for example by way of a welding process, an adhesive-bonding process, a moulding process, and/or any other process considered expedient to the person skilled in the art, and/or advantageously so as to be shaped in one piece such as, for example, by way of a production in a single casting and/or by a production in a single-component or multi-component injection moulding method, and advantageously from a single blank. Two elements being implemented "integrally" is in particular to mean that the units have at least one, in particular at least two, advantageously at least three, common elements which are component parts, in particular functionally relevant component parts, of both units.

It is moreover proposed that the braiding knife is implemented from a flat material, in particular a flat iron, a flat steel, or the like, and that the braiding knife is at least section-wise helically twisted along its longitudinal axis, in particular around a center of the braiding knife that runs along the longitudinal axis. A particularly advantageous implementation of the rectifying unit can be achieved on account thereof. In particular, a rectifying unit of this type advantageously has a low level of complexity. Moreover, a production of a planar helix from high-tensile steel by means of a braiding knife assembly can be advantageously enabled on account thereof. The longitudinal axis of the braiding knife preferably runs parallel with a direction of main extent of the braiding knife. "Section-wise" is in particular to mean at least on a sub-section of the braiding knife, or on more than one sub-section of the braiding knife, along the longitudinal axis of the braiding knife. The sub-section is in particular at least 10%, preferably at least 20%, advantageously at least 30%, preferably at least 50%, and particularly preferably at most 80%, of a total extent of the braiding knife in the direction of the longitudinal axis of the braiding knife. The braiding knife being "helically twisted" is in particular to be understood that at least the narrow outer edges that are disposed opposite one another and/or the narrow outer edges of the braiding knife implemented as flat material which are disposed opposite one another describe screw-shaped paths in the twisted region, said screw-shaped paths being mutually offset by approximately half a turn pitch and coiling around a common center which runs in at least a substantially linear manner.

Overbending, in particular overplying, of a bending region of a helix can advantageously be achieved when a helically twisted section of the braiding knife is twisted by an angle $\alpha$, wherein the angle $\alpha$ is more than 45°, preferably more than 90°, and preferably more than 180°, as a result of which, the helix made of high-tensile steel can advantageously be rectified, in particular rectified in a planar manner. The angle $\alpha$ is in particular realized as an angle which across an entire twisted region of the braiding knife is swept by a narrow outer edge and/or a narrow external side of the braiding knife.

Particularly precise rectifying, in particular planar rectifying, of the helices can advantageously be enabled when the angle $\alpha$ corresponds to an equation $\alpha(1-r)*180°$, wherein r is a material-dependent rebound factor of the helices implemented at least partially from high-tensile steel. In particular, a shape of the braiding knife can advantageously be adapted to a specific longitudinal element having a specific (material-dependent and diameter-dependent) rebound factor on account thereof.

It is furthermore proposed that the braiding knife is twisted multiple times. Particularly effective rectifying, in particular planar rectifying, and/or particularly intense overbending can advantageously be achieved on account thereof. Multiple twisting corresponds in particular to an angle $\alpha$ of more than 360°, preferably of at least 720°.

It is furthermore proposed that the braiding knife is twisted by at least 10°, preferably at least by 20°, advantageously at least by 30°, particularly advantageously at least by 40°, preferably at least by 50°, and particularly preferably by at most 90°, in a region across which a spiral turn of the helix extends when bending a helix by means of the braiding knife assembly. Particularly effective overbending and/or particularly precise rectifying, in particular planar rectifying, of the helices can advantageously be achieved on account thereof. A spiral turn of the helix corresponds in particular to a region of the helix in which the helix is twisted by 360°. A spiral turn of the helix comprises in particular two entire bending regions, one entire first leg, and one entire second leg.

Gradual overbending can advantageously be enabled when a pitch of the helical twist of the braiding knife increases or decreases along the longitudinal axis of the braiding knife. Stresses which arise can advantageously be minimized on account thereof.

It is additionally proposed that the braiding knife has a cross-section, the shape thereof, in particular on a narrow outer edge and/or on a narrow external side of the braiding knife, comprising at least one semicircle. The shape of the cross section of the braiding knife preferably comprises at least one further semicircle on a further narrow outer edge and/or on a further narrow external side of the braiding knife. A particularly advantageous production device can in particular be achieved on account thereof. Damage to the longitudinal elements can advantageously be avoided by rounding off outer edges. Longitudinal elements from high-tensile steel are in particular more brittle, which is why bending around a sharp edge could lead to the longitudinal elements breaking. A risk of breakage is advantageously reduced on account of the design embodiment proposed. Alternatively, the cross section of the braiding knife can also have four rounded-off edges, for example four quadrants.

The braiding knife advantageously has a clearance which permits bridging of the helix by pressing the helix in the region of the clearance when the braiding knife has a cross section, the shape thereof comprising at least one partial circle which is larger than a semicircle. Rectifying of the helix can advantageously be enabled already on the braiding knife on account thereof.

It is moreover proposed that the braiding knife has a cross section, the shape thereof at least in a first, in particular long, lateral face having a convex curvature or a concave curvature. At least partial rectifying of a helix and/or setting of a geometry of the helix can advantageously be enabled on account thereof. In particular, bridging of the helix by pressing the helix against the braiding knife, for example by means of a pressing element, can be enabled on account of a concave curvature. In particular, a helix having legs that are outwardly curved in a bulging manner can be produced on account of a convex curvature. The braiding knife can in particular have a convex curvature on both, in particular long, lateral faces, or have a concave curvature on both, in particular long, lateral faces. However, it is also conceivable for an in particular long lateral face to have a convex curvature, and for a further, in particular long lateral face to have a concave curvature. The in particular long lateral face is in particular embodied as the face of the braiding knife along which the legs of the helix extend in a bending procedure.

It is moreover proposed that the shape of the cross section of the braiding knife at least on a second lateral face that is opposite the first lateral face has a convex curvature or a concave curvature. At least partial rectifying of a helix and/or setting of a geometry of the helix can advantageously be enabled on account thereof.

A geometry of a completely bent helix can advantageously be set and/or a shape of the braiding knife can be adapted to a specific type of longitudinal element, for example as a function of the rebound factor, of the tensile strength, or of the diameter of the longitudinal element, when an extent of an outward curvature of the convex curvature of the braiding knife or an extent of an inward curvature of the braiding knife is capable of being set and/or adjusted. The braiding knife for setting the curvature can have movable surface elements, for example.

Alternatively or additionally, the braiding knife could have a fastening device which enables assembling and/or disassembling of replaceable surface elements.

Moreover, processing of longitudinal elements from materials with a particularly high hardness and/or with particularly high tensile strength can advantageously be enabled when the braiding knife and/or a braiding worm of the braiding knife assembly is at least largely implemented from a material having a Vickers hardness of more than 600 HV 10, in particular without herein causing damage or increased wear on the braiding knife and/or the braiding worm.

It is furthermore proposed that the production device comprises a braiding worm which has a worm thread turn having a turn pitch angle which is smaller than half an opening angle of a bending region of a helix completely bent by the braiding knife and by the braiding worm. Precise setting of a mesh shape of helices from high-tensile steel can advantageously be enabled on account thereof. In particular, the helix can be overbent, in particular overcompressed, in the longitudinal direction of the helix on account thereof.

Precise setting of a mesh shape of helices from high-tensile steel, in particular of the angle of the end point in a view perpendicular to the plane of main extent of the helix, can advantageously be enabled when the pitch of the worm thread turn of the braiding worm is less than 0.9 times, preferably less than 0.8 times, half the opening angle of the bending region of the helix completely bent by the braiding knife and by the braiding worm.

Moreover, gradual overbending can in particular be advantageously enabled when the braiding worm has a worm thread turn having a variable turn pitch angle. Stresses that arise can advantageously be minimized on account thereof.

It is furthermore proposed that the rectifying unit has a pressing device which is at least configured for at least partially rectifying, in particular in a planar manner, said helix by pressing a helix against the braiding knife. A particularly suitable production device for producing helices of chain-link nets having particularly advantageous net properties can advantageously be achieved on account thereof. On account thereof, planar helices which are composed of high-tensile steel can advantageously be produced by means of the braiding knife assemblies. The pressing device is in particular configured for pressing the helix in a planar or punctiform manner against the braiding knife.

A particularly efficient rectifying procedure can advantageously be achieved when the pressing device has at least one pressing element which is adapted to an external shape of the braiding knife, in particular to a helical shape and/or to a concavely and/or convexly curved shape of the braiding knife. In particular, the pressing element at least in a contact region configured for pressing the helix against the braiding knife has an external shape which at least section-wise is at least substantially complementary to the external shape of the braiding knife. It is conceivable that the pressing element at least section-wise is conjointly moved with the trailing longitudinal element, in particular so as to be synchronous with the latter, along the longitudinal axis of the braiding knife.

It is moreover proposed that the pressing device has at least one pressing element which in at least one transition region of the helix, preferably in at least two transition regions of the helix, lying between a bending region of the helix and at least one leg of the helix that neighbors the bending region, is configured for pressing a helix wound onto the braiding knife against the braiding knife, in particular in a punctiform manner. A particularly suitable production device for producing helices of chain-link nets having particularly advantageous net properties can advantageously be achieved on account thereof. On account thereof, planar helices that are composed of high-tensile steel can advantageously be produced by means of the braiding knife assemblies.

A particularly effective rectifying procedure can advantageously be achieved when at least the pressing element is movably mounted and at least section-wise is configured for following at least one rotating movement of the braiding knife, in particular since an interruption of the rotating movement of the braiding knife for pressing can be kept as short as possible, or an interruption of the rotating movement of the braiding knife can preferably be dispensed with.

It is furthermore proposed that the portion of the rectifying unit that is disposed downstream has at least two mutually counter-rotatable rectifying elements and/or at least two rectifying elements that are longitudinally displaceable, counter to one another, in directions which run at least substantially parallel with the longitudinal axis of the braiding knife, said rectifying elements being configured for rectifying the helix, in particular in a planar manner. Precise setting of a helix geometry of helices from high-tensile steel can advantageously be enabled on account thereof. On account thereof, planar helices that are composed of high-tensile steel can advantageously be produced by means of the braiding knife assemblies. The rectifying elements are in particular configured for firmly holding a helix to be rectified, and for subsequently rectifying said helix by the rotation in opposite directions and/or the longitudinal displacement in opposite directions. The rectifying unit in particular has a further drive unit which is configured for generating the rotation in opposite directions and/or the longitudinal displacement of the rectifying elements in opposite directions. The production device in particular has an control and/or regulation unit which is at least configured for controlling the movements generated by the drive unit and/or by the further drive unit. An "control and/or regulation unit" is in particular to be understood to be a unit having at least one electronic control system. An "electronic control system" is in particular to be understood to be a unit having a processor unit and having a storage unit as well as an operating program stored in the storage unit. In particular, the counter-rotatable rectifying elements are rotatable around an axis which runs so as to be parallel with the longitudinal axis of the braiding knife.

The angle of the bending region of the helix implemented from high-tensile steel, in the view perpendicular to the plane of main extent of the helix, can advantageously be precisely set when the rectifying elements, particular the longitudinally displaceable rectifying elements, are configured for pulling apart at least sub-regions of an in particular tightly wound helix in the longitudinal direction of the helix. The rectifying elements are in particular configured for pulling apart the sub-region of the helix so far that, upon rebounding of the helix, an envisaged angle, in particular an opening angle of 90°, is established. The rectifying elements are preferably configured for pulling apart the entire helix.

Moreover, the helix implemented from high-tensile steel can advantageously be rectified, in particular rectified in a planar manner, if the rectifying elements, in particular the rotatable rectifying elements, are configured for overbending at least sub-regions of an, in particular rotationally distorted, helix by a counter-rotation of two neighboring rectifying elements around a central longitudinal axis of the helix.

A "rotationally distorted" helix is in particular to mean a helix in which the center points of the first leg do not lie on one common plane, or in which the center points of the second leg do not lie on one common plane.

Furthermore proposed is a chain-link net device, in particular a chain-link net, preferably a safety chain-link net, comprising a plurality of interconnected helices, which are in particular rotated into one another and of which at least one helix is produced from at least one longitudinal element, in particular a single wire, a wire bundle, a wire strand and/or a wire rope, with at least one wire that is at least partially implemented of a high-tensile steel, and comprises at least one first leg, at least one second leg, as well as at least one bending region that interconnects the first leg and the second leg, wherein the connected helices, in a frontal view perpendicular to a plane of main extent of the helices, realize an at least substantially square mesh-shape, and wherein the legs of the interconnected helices, in a transverse view parallel with the plane of main extent of the helices, are, in particular outwardly, curved in a bulging manner. On account thereof, chain-link nets having particularly advantageous net properties, in particular in terms of an absorption of energy by the chain-link net and/or in terms of the elongation properties of the chain-link net, can be achieved. It can be achieved in particular by a square mesh shape that the chain-link net has at least two preferred directions of elongation. Forces which can act in a circular manner in all directions arise in particular in the event of a rock burst in a mine. Forces of this type can in particular be better absorbed by a square mesh net than with a mesh net having diamond-shaped meshes, for example. Moreover, an energy absorption capability of the chain-link net can be further improved in particular on account of the combination with the bulging curvature of the legs of the helix. On account of the bulging shape of the legs, spring properties of the high-tensile steel can advantageously be utilized for an additional absorption of energy. At least a portion of an energy that in the event of an impact is introduced into the chain-link net can advantageously be absorbed by in particular elastic flexing of the bulging shape of the legs, in particular before a plastic deformation of the helix arises. The bulging shape of the legs moreover advantageously imparts to the chain-link net further improved elongation properties. In particular, a maximum potential elastic elongation of the chain-link net is advantageously increased. A leg being "curved in a bulging manner" is in particular to be understood that the leg is curved, preferably curved towards the right, at least in a central region around the center point of the leg.

Particularly positive elongation properties and/or particularly positive energy absorption properties can advantageously be achieved when the bulging curvature of the legs of the interconnected helices in the transverse view, in particular in the central region around the center point of the leg, has an in particular maximum curvature radius of at most 50 cm, preferably of at most 30 cm, advantageously of at most 17 cm, particularly advantageously of at most 15 cm, preferably of at most 10 cm, and particularly preferably of at most 5 cm.

Moreover, particularly positive elongation properties and/or particularly positive energy absorption properties and simultaneously sufficient stability can advantageously be achieved when the bulging curvature of the legs of the interconnected helices in the transverse view, in particular in the central region around the center point of the leg, has an in particular maximum curvature radius of at least 3 cm, preferably of at least 5 cm, advantageously of at least 7 cm, particularly advantageously of at least 10 cm, preferably of at least 13 cm, and particularly preferably of at most 15 cm.

Moreover, positive retention properties of the mesh net also for comparatively small impacting bodies can advantageously be achieved when the square mesh shape has an edge length of at least 3 cm, preferably at least 5 cm, and preferably at least 7 cm. Moreover, a mesh width of this type advantageously enables in particular simple assembly using commercially available rock anchors.

Positive retention properties of the mesh net, that is to say an adequate reliability for a multiplicity of applications and simultaneously an ideally low chain-link net weight can advantageously be achieved when the square mesh shape has an edge length of at most 20 cm, preferably at most 15 cm, and preferably at most 10 cm.

A chain-link net with increased spring travel can advantageously be achieved when the helix in the bending region, in particular in the view parallel with the direction of main extent of the chain-link net and along the longitudinal direction of the helix, is bent by a bending angle of less than 180°, in particular less than 179°, preferably less than 178°, and preferably less than 175°, on account of which advantageously improved energy absorption properties and/or advantageously improved elongation properties can be achieved.

Moreover, a sufficiently high stability of the chain-link net and simultaneously advantageous energy absorption properties and/or elongation properties can advantageously be achieved when the helix in the bending region is bent by a bending angle of more than 145°, preferably of more than 155°, preferably of more than 170°, and particularly preferably of more than 174°.

It is moreover proposed that a curvature radius of the bulging curvature of at least one helix of the plurality of helices varies substantially in relation to at least one further helix of the plurality of helices. An absorption of energy in multiple stages, for example a dual-stage absorption of energy in the case of two different helix types within a chain-link net, can advantageously be achieved on account thereof, for example in that, when a tensile force is applied to the chain-link net, a majority of the tensile force is first absorbed by helices having comparatively small curvature radii, and the further helices having comparatively large curvature radii are equally stressed only once the applied tensile forces increase. On account thereof, a chain-link net having advantageous stress properties can in particular be achieved.

It is furthermore proposed that the longitudinal element composed of the high-tensile steel wire has a diameter of at least 2 mm, preferably at least 3 mm, advantageously at least 4 mm, preferably at least 5 mm, and particularly preferably at most 6 mm. On account thereof, a chain-link net having particularly advantageous properties, particularly in terms of a resistance force-to-weight ratio, can advantageously be obtained. The longitudinal element particularly advantageously has a diameter of 4.6 mm. Experiments have demonstrated chain-link nets having a particularly advantageous weight-to-area ratio can be produced from longitudinal elements of this diameter, said chain-link nets are particularly suitable for use in underground mining since the weight-to-area ratio of said chain-link nets is particularly suitable for handling and installing by machines usually used in underground mining. Moreover, the chain-link net having longitudinal elements of this diameter offers a particularly strong protection in relation to a majority of the rockfall events typically arising in underground mining, and simultaneously an ideally low area weight.

It is additionally proposed that a mean maximum perpendicular spacing of two bulgingly curved legs of a helix that are interconnected by a bending region, particularly when viewed along the longitudinal direction of a helix, is at least 4 times, preferably at least 6 times, preferably at least 10 times, and particularly preferably at most 20 times, a diameter of the longitudinal element of the helix, in particular of the helix. On account thereof, a three-dimensional, mattress-type structure which has advantageous properties in terms of energy absorption and/or in terms of elongation capability can advantageously be achieved.

It is moreover conceivable for a maximum perpendicular spacing of two bulgingly curved legs of a helix that are interconnected by a bending region, particularly when viewed along the longitudinal direction of a helix, is at least 1.02 times, preferably at least 1.03 times, preferably at least 1.05 times, and particularly preferably at least 1.15 times a minimum, in particular perpendicular, spacing of the two legs of the helix which are arranged outside of the bending region and outside of the transition region and which are curved in a bulging manner and interconnected by the bending region, particularly when viewed along the longitudinal direction of a helix.

It is furthermore proposed that a mesh net that is implemented by the connected helices and is completely spread out on a planar surface has an undulation W of at least 2*D, preferably 5*D, wherein the parameter D in the transverse view of the helices of the mesh net corresponds to a mean maximum perpendicular spacing of two legs of a helix of the mesh net that are interconnected by a bending region. A further increased energy absorption capability and/or a further increased elongation capability can advantageously be obtained on account thereof.

Moreover proposed is a use of the chain-link net device for trapping and/or retaining rocks in mining, in slope stabilization, in rockfall and/or avalanche protection or the like, and/or a use of the chain-link net device for trapping vehicles, for example in motorsports, or for counterterrorism. A high degree of safety can advantageously be achieved on account thereof, in particular by virtue of the increased energy absorption properties and/or elongation properties.

Moreover proposed is a use of the chain-link net device for securing a nut in a force-fitting manner. An advantageous screw safeguard of low complexity can in particular be achieved on account thereof. To this end, the rebounding property of the high-tensile steel is in particular combined with the three-dimensional, energy-absorbing geometry of the chain-link net in a meaningful and surprising manner. The chain-link net is in particular configured for forcing a nut counter to a tensioning direction of the nut, said nut being braced in a direction perpendicular to the plane of main extent of the chain-link net, and to thus achieve force-fitting securing of the nut, in particular in a manner comparable to the function of a spring disc.

The method according to the invention for producing helices, the production device according to the invention for producing helices, the chain-link net device according to the invention, and/or the uses according to the invention of the chain-link net device herein is/are not to be limited to the application and embodiment described above. In particular, the method according to the invention for producing helices, the production device according to the invention for producing helices, the chain-link net device according to the invention, and/or the uses according to the invention of the chain-link net device for meeting a functional mode described herein can have a number of individual elements, components, and units that deviates from the number mentioned herein.

DRAWINGS

Further advantages are derived from the description of the drawings hereunder. Seven exemplary embodiments of the invention are illustrated in the drawings. The drawings, the description, and the claims include numerous features in combination. The person skilled in the art will expediently also consider the features individually and combine said features so as to form meaningful further combinations.

Figure 7A:
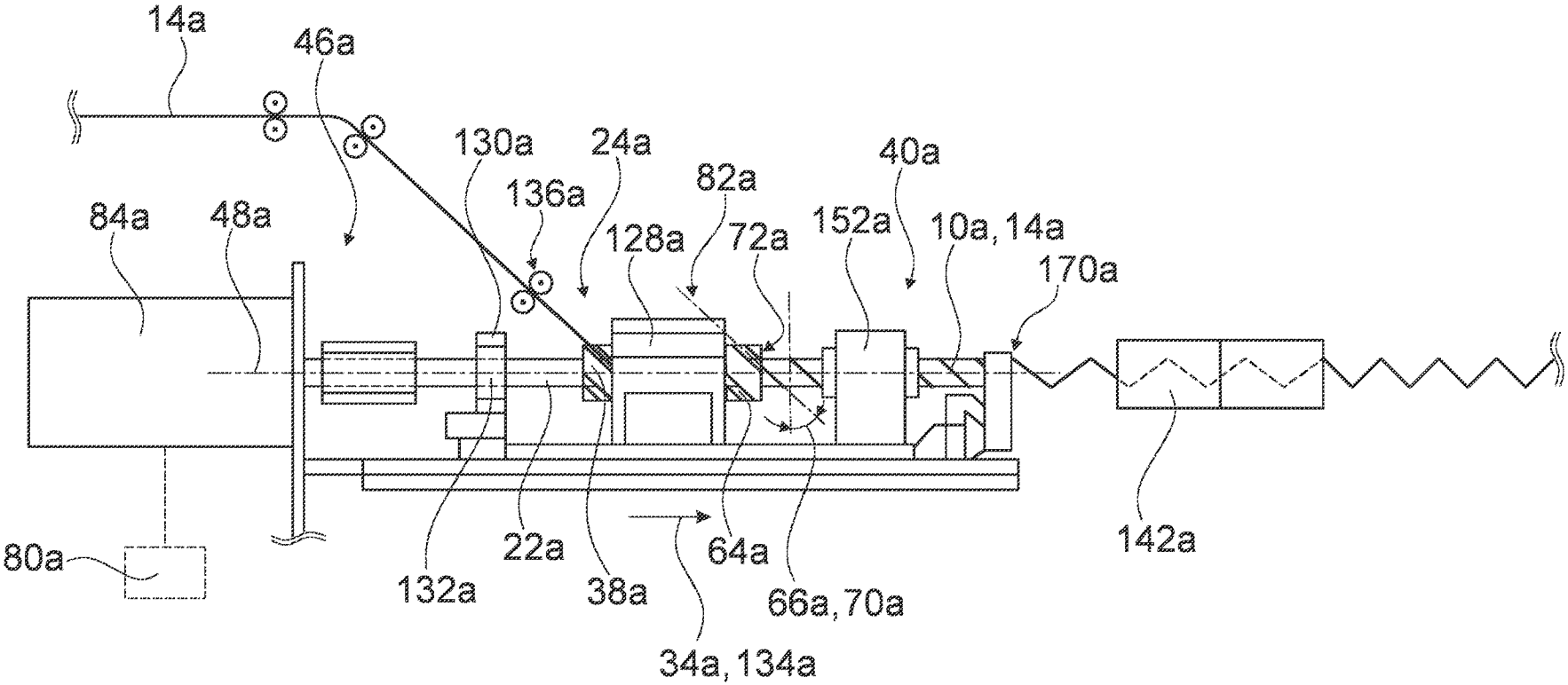
Figure 7B:
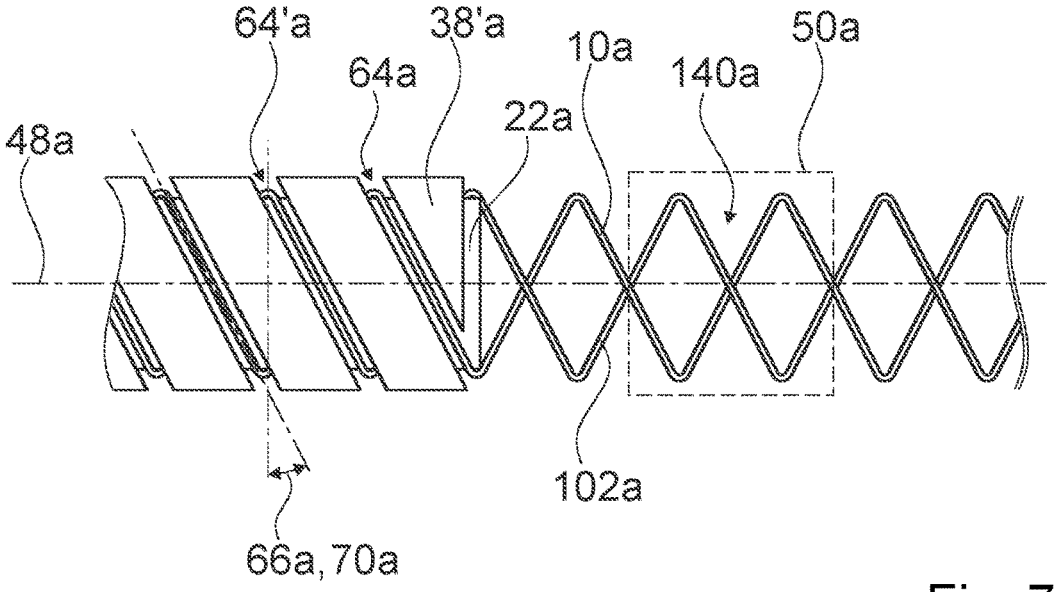
Figure 8A:
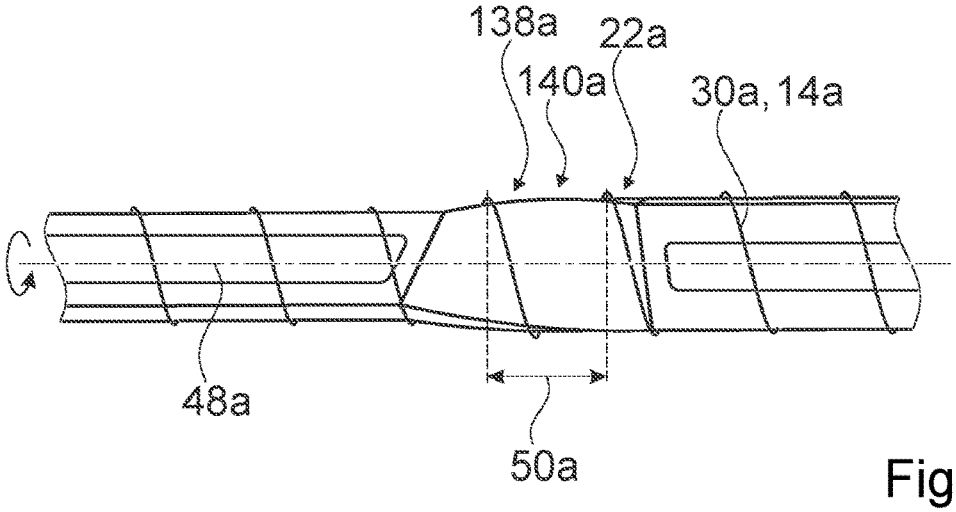
Figure 8B:
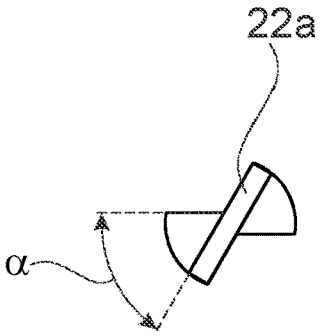
Figure 8C:
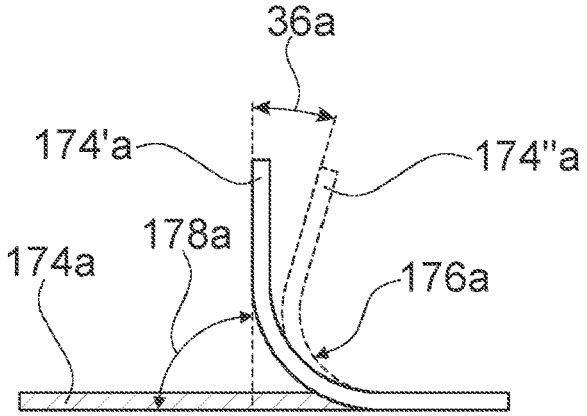
Figure 9:
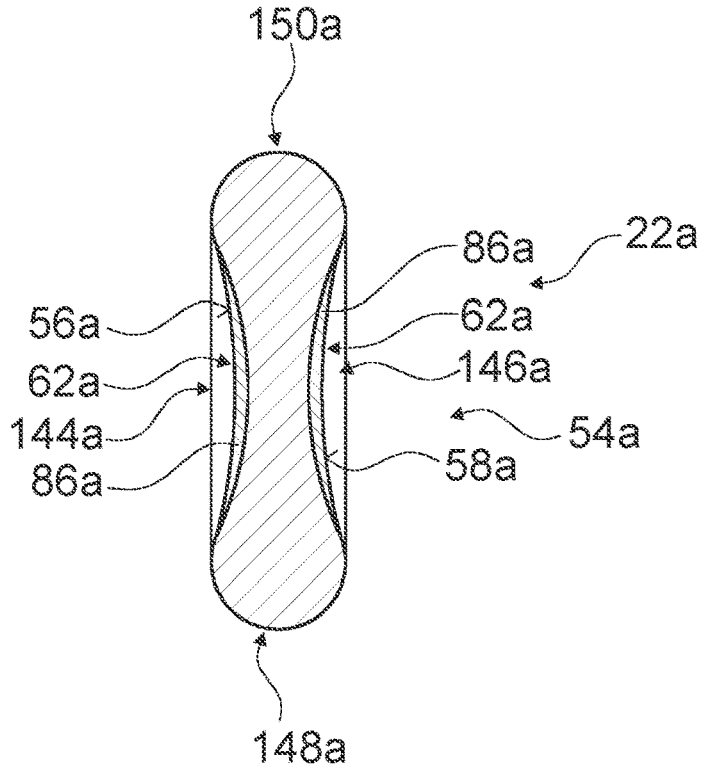
Figure 10:
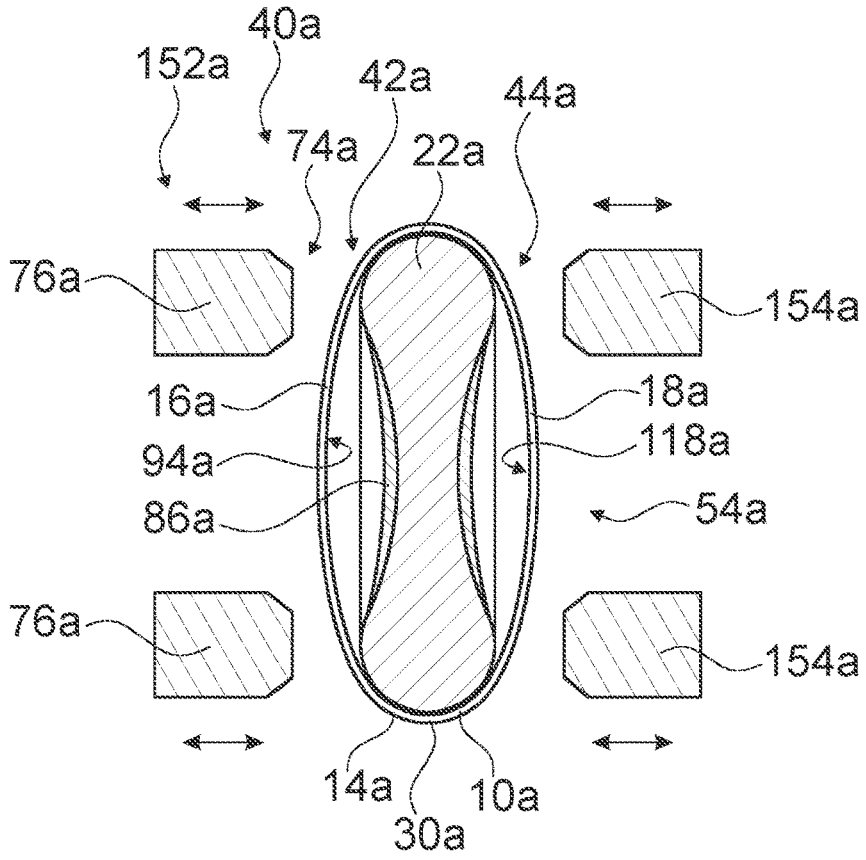
Figure 11:
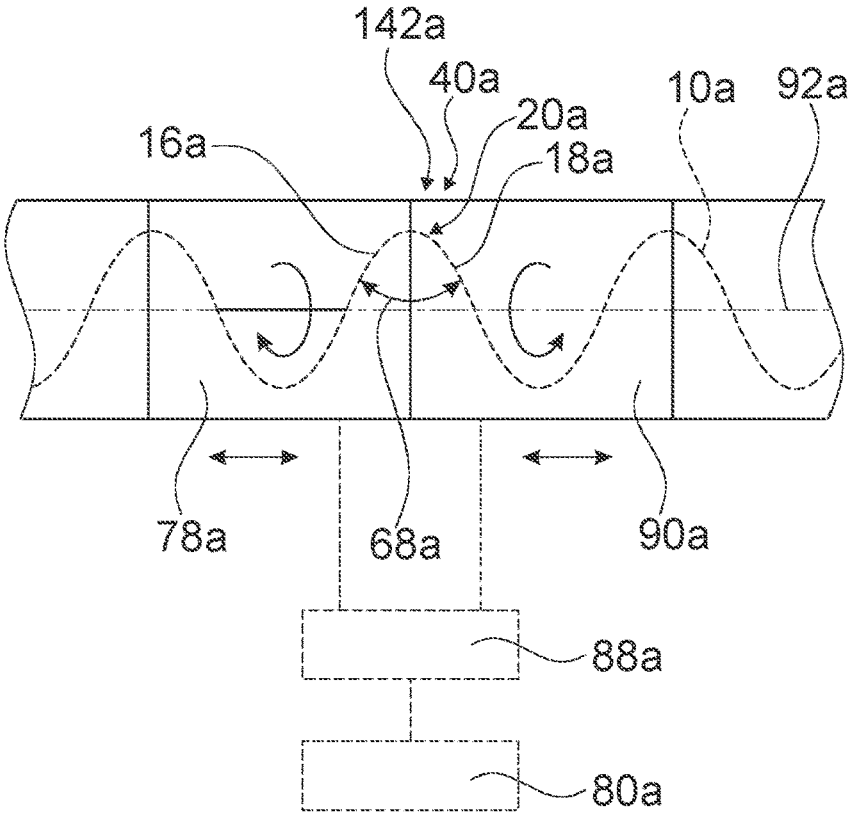
Figure 12A:
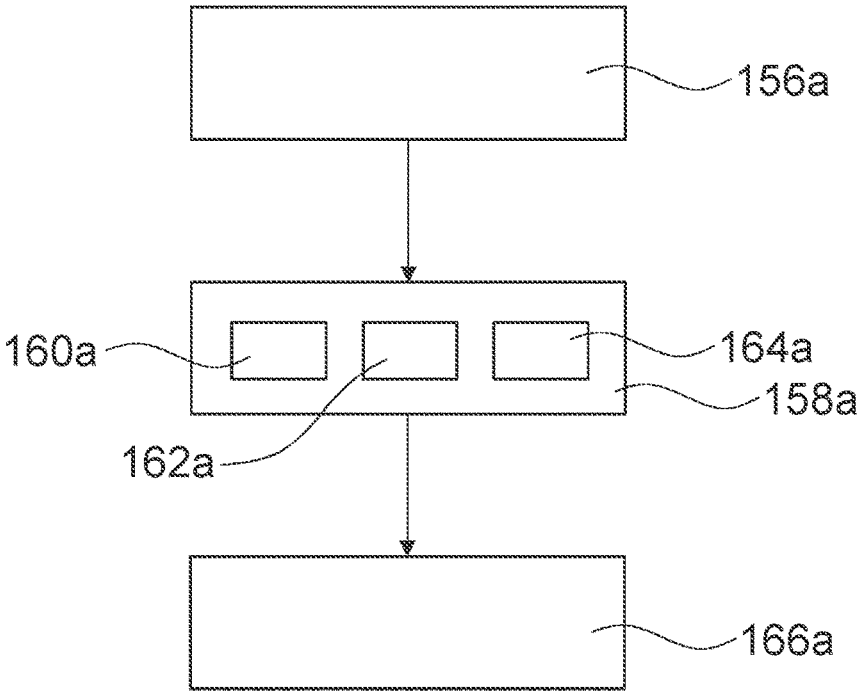
Figure 12B:
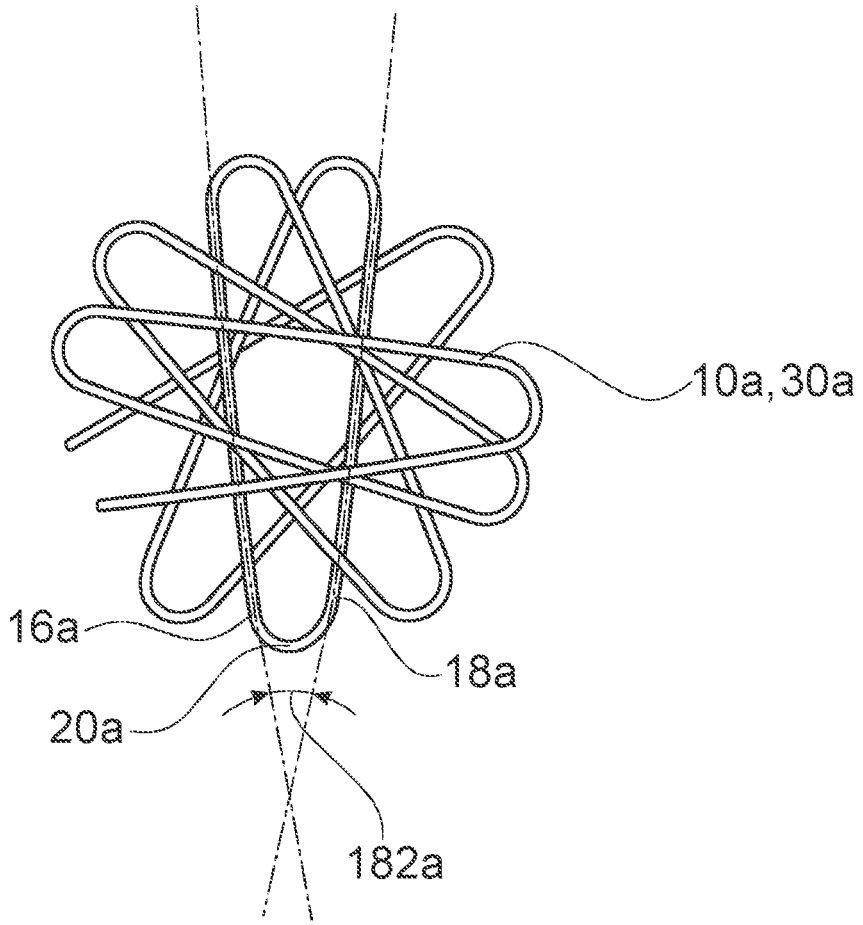
Figure 13:
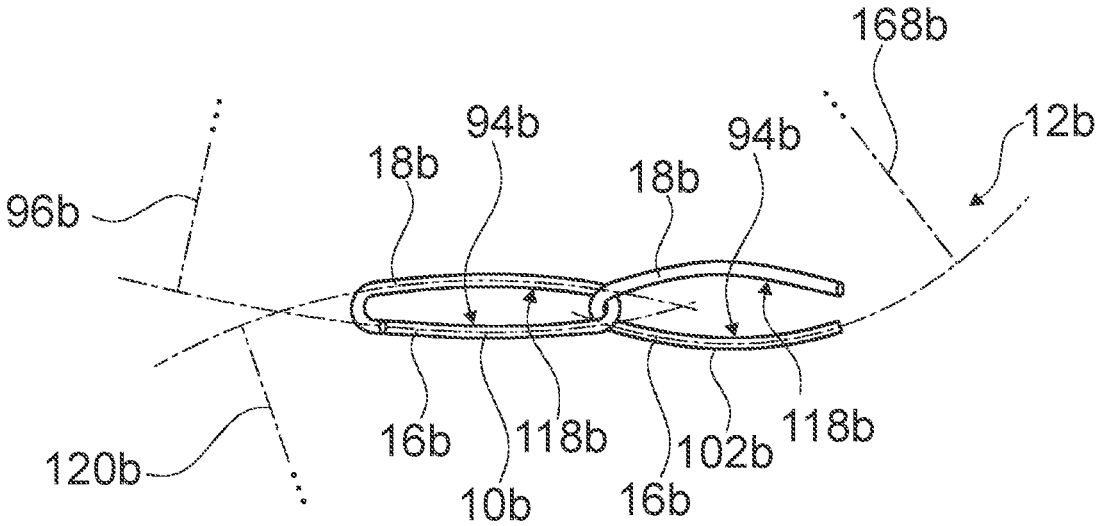
Figure 14:
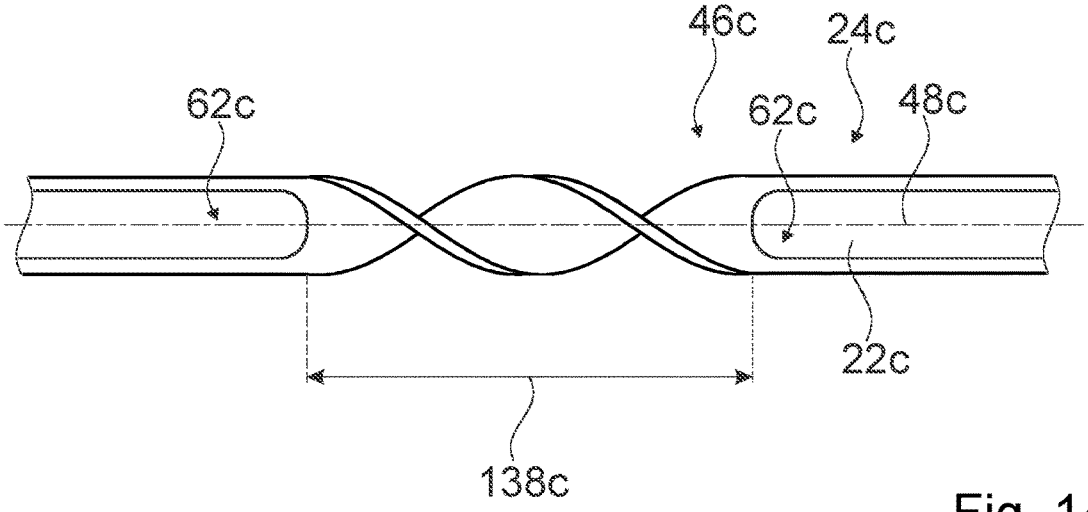
Figure 15:
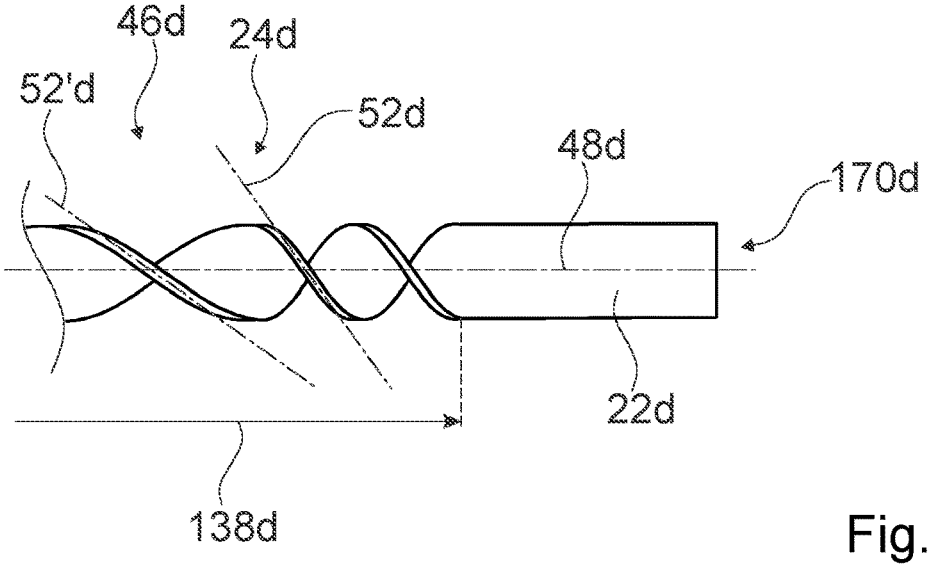
Figure 16:
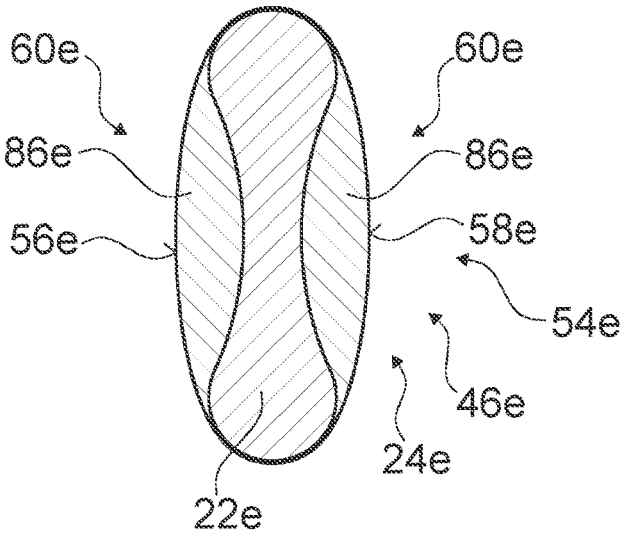
Figure 17:
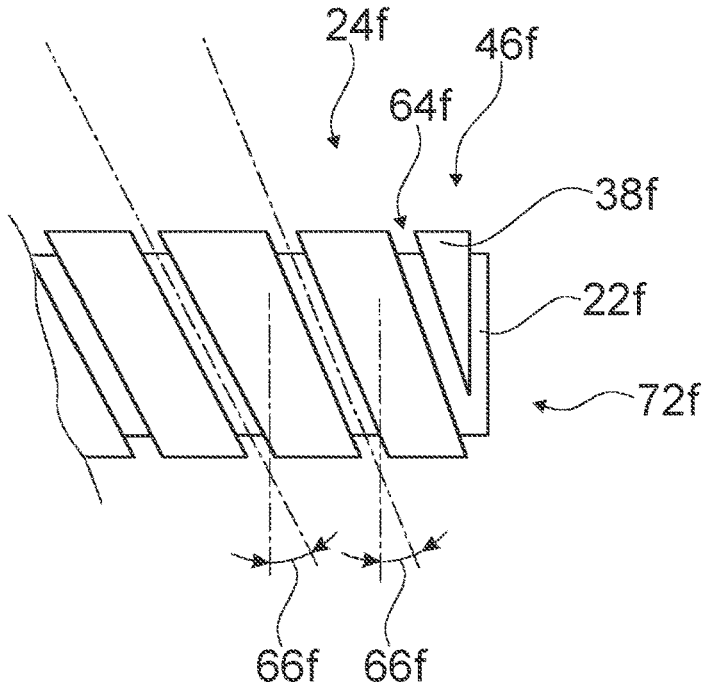
Figure 18:
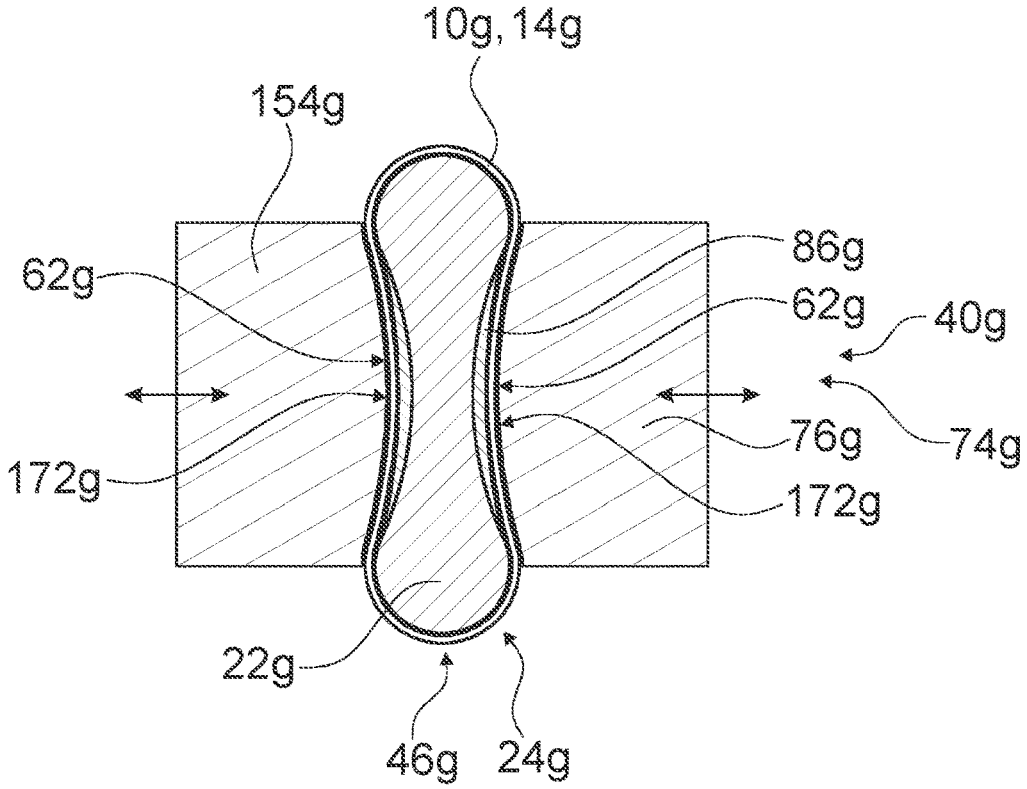

FIG. 7*a* shows a schematic view of a production device for producing the helices;

FIG. 7*b* shows a schematic view of part of an alternative production device for producing the helices;

FIG. 8*a* shows a schematic lateral view of a braiding knife of the production device;

FIG. 8*b* shows a schematic plan view of the braiding knife;

FIG. 8*c* shows a schematic illustration of an overbending angle;

FIG. 9 shows a schematic perpendicular section through the braiding knife at a non-twisted location of the braiding knife;

FIG. 10 shows a schematic perpendicular section through the braiding knife and through a portion of a rectifying unit of the production device;

FIG. 11 shows a schematic view of a further portion of the rectifying unit;

FIG. 12*a* shows a sequence diagram of a method for producing the helices of the chain-link net;

FIG. 12*b* shows in an exemplary manner a non-rectified helix, in particular non-rectified in a planar manner, FIG. 13 shows a schematic view of an alternative chain-link net;

FIG. 14 shows a schematic view of an alternative production device having an alternative braiding knife assembly;

FIG. 15 shows a schematic view of a further alternative production device having a further alternative braiding knife assembly;

FIG. 16 shows a schematic view of a second further alternative production device having a second further alternative braiding knife assembly;

FIG. 17 shows a schematic view of a third further alternative production device having a third further alternative braiding knife assembly; and FIG. 18 shows a schematic view of part of the fourth alternative production device having an alternative rectifying unit.

DESCRIPTION OF THE EXEMPLARY EMBODIMENTS

Figure 1:
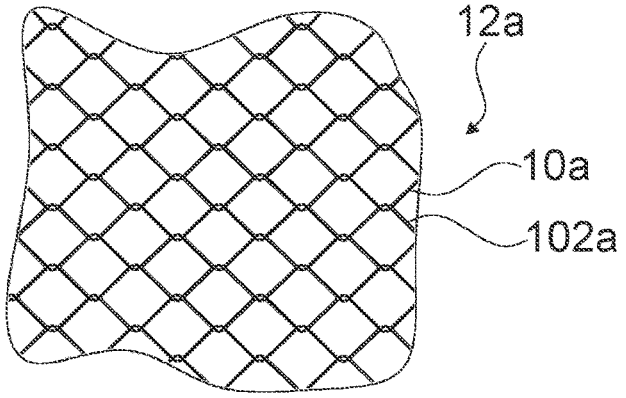
FIG. 1 shows a schematic frontal view of part of a chain-link net.

FIG. 1 shows part of a chain-link net device. The chain-link net device implements a chain-link net 12*a*. The chain-link net 12*a* implements a safety chain-link net which is configured for use as a trapping and/or retention net for trapping and/or retaining rocks in mining, in slope stabilization, in rockfall and/or avalanche protection or the like, and/or for trapping vehicles, for example in motorsports, or for counterterrorism.

The chain-link net device comprises at least one helix 10*a*. The chain-link net device comprises at least one further helix 102*a*. The helix 10*a* and the further helix 102*a* in the present case are implemented so as to be substantially mutually identical. Alternatively, at least part of the helices 10*a*, 102*a* can be implemented so as to be different from a balance of the helices 10*a*, 102*a* of a chain-link net 12*a* (cf. also FIG. 13). The chain-link net 12*a* comprises a plurality of interconnected helices 10*a*, 102*a*. Neighboring helices 10*a*, 102*a* are interconnected by being rotated into one another.

Figure 2:
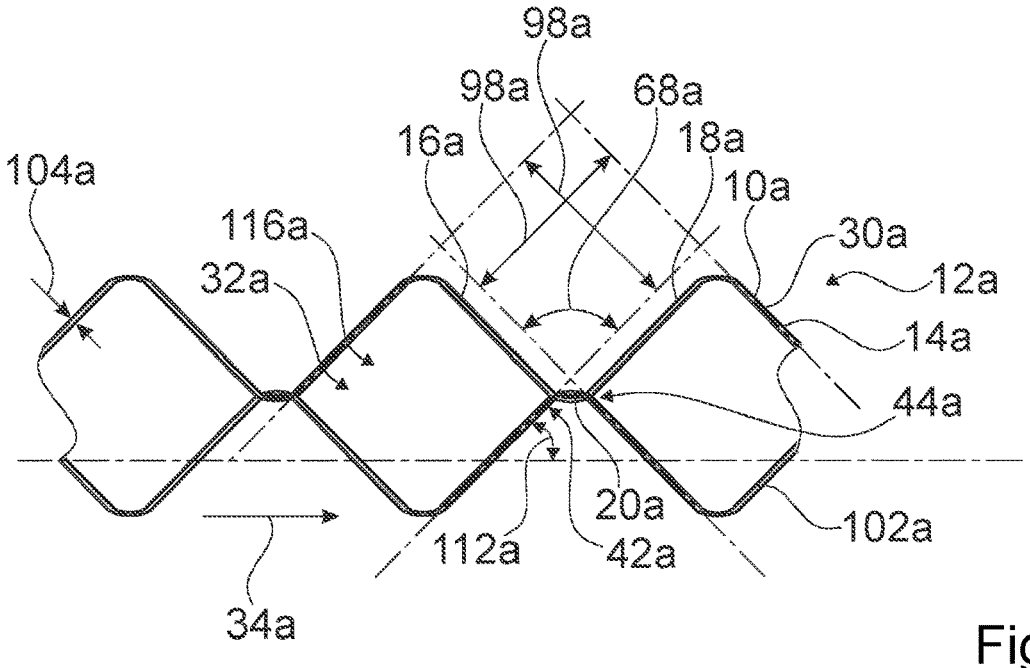
FIG. 2 shows a schematic frontal view of part of two interconnected helices of the chain-link net.

FIG. 2 shows part of the chain-link net 12*a* in a schematic front view. The helices 10*a*, 102*a* are respectively produced from a longitudinal element 14*a* having at least one wire 30*a*. The longitudinal element 14*a* in the present case is embodied as a single wire. The wire 30*a* in the present case forms the longitudinal element 14*a*. The longitudinal element 14*a* is bent so as to form the helix 10*a*. The helix 10*a*, 102*a* is embodied in a one-part implementation. The helix 10*a*, 102*a* is produced from a single wire piece. It is also conceivable for the longitudinal element 14*a* to be implemented as a wire bundle, a wire strand, a wire rope, or the like. The wire 30*a* in the present case is implemented completely from high-tensile steel. The wire 30*a* implemented from high-tensile steel in the exemplary embodiment shown has a tensile strength of 1770 N/mm$^2$. The longitudinal element 14*a*, in particular the wire 30*a*, in the exemplary embodiment shown has a diameter 104*a* of 4.6 mm. Alternatively, it is conceivable for a wire 30*a* to have another diameter 104*a*, such as, for example, less than 1 mm, or approximately 1 mm, or approximately 2 mm, or approximately 4 mm, or approximately 5 mm, or approximately 6 mm, or an even larger diameter 104*a*.

The helix 10*a*, 102*a* has a first leg 16*a*. The helix 10*a*, 102*a* has a second leg 18*a*. The helix 10*a*, 102*a* has a bending region 20*a* that connects the first leg 16*a* and the second leg 18*a*. The helix 10*a*, 102*a* in the case illustrated has a multiplicity of first legs 16*a*, a multiplicity of second legs 18*a*, as well as a multiplicity of bending regions 20*a*, not all of which being provided with reference numerals for reasons of clarity. Furthermore, the first legs 16*a* are implemented so as to be at least substantially mutually identical. Moreover, the second legs 18*a* are implemented so as to be at least substantially mutually identical. Moreover, the bending regions 20*a* are implemented so as to be at least substantially mutually identical. Therefore, the first leg 16*a*, the second leg 18*a*, and the bending region 20*a* are described in more detail hereunder by way of example. Of course, it is conceivable for the chain-link net 12*a* to have dissimilar first legs 16*a* and/or dissimilar second legs 18*a* and/or dissimilar bending regions 20*a*.

The helix 10*a*, 102*a* has a transition region 42*a*. The transition region 42*a* is formed by the region which lies between a bending region 20*a* of the helix 10*a*, 102*a* and at least one first leg 16*a* of the helix 10*a*, 102*a* that neighbors the bending region 20*a*. The helix 10*a*, 102*a* has a second transition region 44*a*. The second transition region 44*a* is formed by the region which lies between a bending region 20*a* of the helix 10*a*, 102*a* and at least one second leg 18*a* of the helix 10*a*, 102*a* that neighbors the bending region 20*a*.

The helix 10*a*, 102*a* has a longitudinal direction 34*a*. The longitudinal direction 34*a* corresponds to a direction of main extent of the helix 10*a*, 102*a*. The first leg 16*a*, in a frontal view perpendicular to a plane of main extent of the helix 10*a*, 102*a* runs at a pitch angle 112*a* in relation to the longitudinal direction 34*a* of the helix 10*a*, 102*a*. The pitch angle 112*a* is approximately 45°. The frontal view is in particular a view in a frontal direction 114*a* (cf. FIG. 3*a*). The connected helices 10*a*, 102*a* in the frontal view perpendicular to the plane of main extent of the helices 10*a*, 102*a* implement meshes 116*a*. The meshes 116*a* have an at least substantially square mesh-shaped 32*a*. The meshes 116*a* of the square mesh shape 32*a* in the corners thereof respectively comprise four substantially right angles. The legs 16*a*, 18*a* that delimit the meshes 116*a* of the square mesh shape 32*a* are of substantially equal length. The square mesh shape 32*a* in the case illustrated has an edge length 98*a* of 5 cm. The edge length 98*a* corresponds to a length of the first leg 16*a*. The mesh length 98*a* corresponds to a length of the second leg 18*a*.

Alternatively, it is conceivable for the square mesh shape 32*a* to have another edge length 98*a*, for example of 3 cm, 4 cm, 6 cm, 7 cm, 10 cm, or more than 10 cm.

Figure 3:
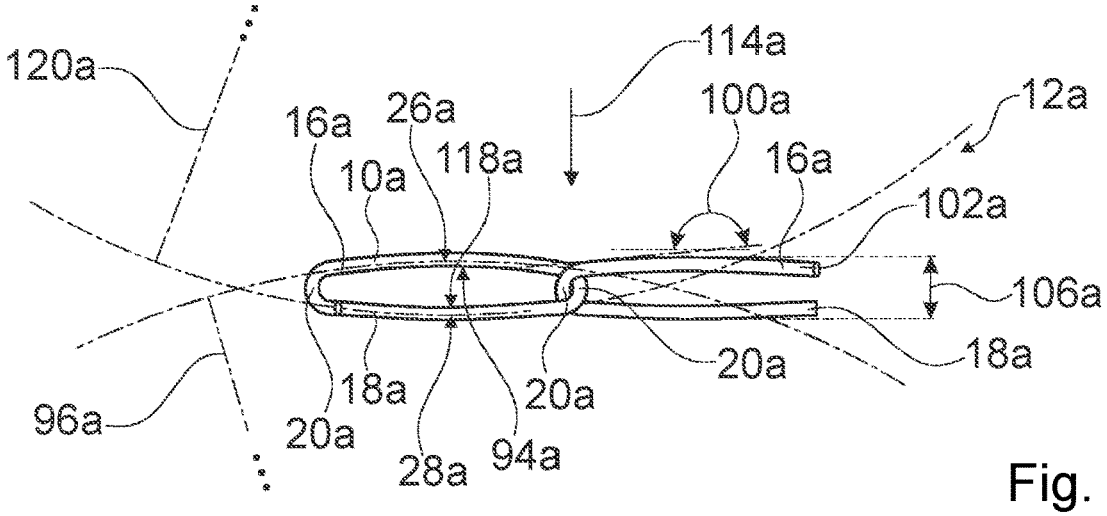
FIG. 3 shows a schematic view of the helices along a longitudinal direction of the helices.

FIG. 3 in a view along the longitudinal direction 34*a* of the helices 10*a*, 102*a* shows a portion of the helices 10*a*, 102*a* of the chain-link net 12*a* that comprises respectively the first leg 16*a*, the second leg 18*a*, as well as the bending region 20*a*. The helices 10*a*, 102*a* of the chain-link net 12*a* contact one another at the respective bending regions 20*a* of said helices 10*a*, 102*a*. The first leg 16*a* of the interconnected helices 10*a*, 102*a* in a transverse view parallel with the plane of main extent of the helices 10*a*, 102*a* is curved in a bulging manner. The first leg 16*a* has a first bulging curvature 94*a*. The second leg 18*a* of the interconnected helices 10*a*, 102*a* in the transverse view parallel with the plane of main extent of the helices 10*a*, 102*a* is curved in a bulging manner. The second leg 18*a* has a second bulging curvature 118*a*. The legs 16*a*, 18*a*, are curved outward out of the plane of main extent of the chain-link net 12*a*. The first leg 16*a* of the helix 10*a* is curved in a direction perpendicular to the longitudinal direction 34*a* of the helix 10*a* and perpendicular to the plane of main extent of the chain-link net 12*a*. The second leg 18*a* of the helix 10*a* is curved in a direction perpendicular to the longitudinal direction 34*a* of the helix 10*a* and perpendicular to the plane of main extent of the chain-link net 12*a*. The bulging curvatures 94*a*, 118*a* of the legs 16*a*, 18*a* point in directions that face away from one another, in particular opposite directions. The helices 10*a*, 102*a* when viewed along the longitudinal direction 34*a* of the helices 10*a*, 102*a* have an at least substantially elliptic shape. The bulging curvatures 94*a*, 118*a* of the legs 16*a*, 18*a*, are implemented so as to be substantially mutually identical, except for the mutually opposite alignment. The transverse view is in particular a view along the longitudinal direction 34*a* of the helices 10*a*, 102*a*.

The first leg 16*a* has a center point 26*a*. The center point 26*a* of the first leg 16*a* is disposed in a center of an overall extent of the first leg 16*a*, between two adjacent bending regions 20*a* of the helix 10*a*. The bulging curvature 94*a* of the first leg 16*a* in the transverse view in a central region around the center point 26*a* of the first leg 16*a* has a curvature radius 96*a* of less than 17 cm. The bulging curvature 94*a* of the first leg 16*a* in the transverse view in the central region around the center point 26*a* of the first leg 16*a* in the case illustrated has a curvature radius 96*a* of 15 cm. Alternatively, the bulging curvature 94*a* of the first leg 16*a* can also have a curvature radius 96*a* of more than 17 cm. The central region around the center point 26*a* of the first leg 16*a*, proceeding from the center point 26*a*, extends uniformly across 50% of the overall extent of the first leg 16*a* in both directions of the first leg 16*a*. The second leg 18*a* has a center point 28*a*. The center point 28*a* of the second leg 18*a* is disposed in a center of an overall extent of the second leg 18*a*, between two adjacent bending regions 20*a* of the helix 10*a*. The bulging curvature 118*a* of the second leg 18*a* in the transverse view in a central region around the center point 28*a* of the second leg 18*a* has a curvature radius 120*a* of less than 17 cm. The bulging curvature 118*a* of the second leg 18*a* in the transverse view in the central region around the center point 28*a* of the second leg 18*a* in the case illustrated has a curvature radius 120*a* of 15 cm. Alternatively, the bulging curvature 118*a* of the second leg 18*a* can also have a curvature radius 120*a* of more than 17 cm. The central region around the center point 28*a* of the second leg 18*a*, proceeding from the center point 28*a*, extends uniformly across 50% of the overall extent of the second leg 18*a* in both directions of the second leg 18*a*.

The helices 10*a*, 102*a* at the bending region 20*a* are bent by a bending angle 100*a* of less than 180°. The helices 10*a*, 102*a* at the bending region 20*a* are bent by a bending angle 100*a* of more than 145°. The helices 10*a*, 102*a* at the bending region 20*a* are bent by a bending angle 100*a* of approximately 175°. The two center points 26*a*, 28*a* of legs 16*a*, 18*a* which are interconnected by the bending region 20*a* and are curved in a bulging manner, in the transverse view realize a maximum perpendicular spacing 106*a*. A mean value of the maximum perpendicular spacing 106*a* of legs 16*a*, 18*a* of a helix 10*a* which are interconnected by bending regions 20*a* and are curved in a bulging manner is at least 4 times and at most 20 times the diameter 104*a* of the longitudinal element 14*a* of the helices 10*a*, 102*a*. The mean maximum perpendicular spacing 106*a* in the case illustrated is 4 times the diameter 104*a* of the helix 10*a*.

Figure 4:
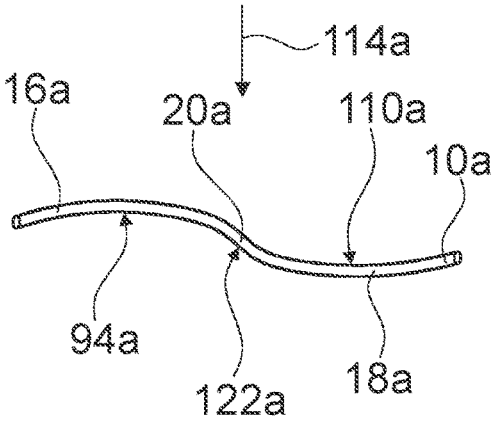
FIG. 4 shows a schematic view of part of the helix, viewed from a direction parallel with the plane of main extent of the chain-link net and perpendicular to the longitudinal direction of the helix.

FIG. 4 shows a schematic view of part of the helix 10*a* viewed from a direction parallel with the plane of main extent of the chain-link net 12*a* and perpendicular to the longitudinal direction 34*a* of the helix 10*a*. The bending region 20*a* of the helix 10*a* has an S-shape 122*a*. The bulging curvatures 94*a*, 118*a* can also be readily seen from this perspective. The bulging curvatures 94*a*, 118*a* have in particular the effect of an increased spring capacity in the event of forces which act on the chain-link net 12*a* in the frontal direction 114*a*, indicated by an arrow in FIG. 4, or in a direction opposite to the frontal direction 114*a*.

Figure 5:
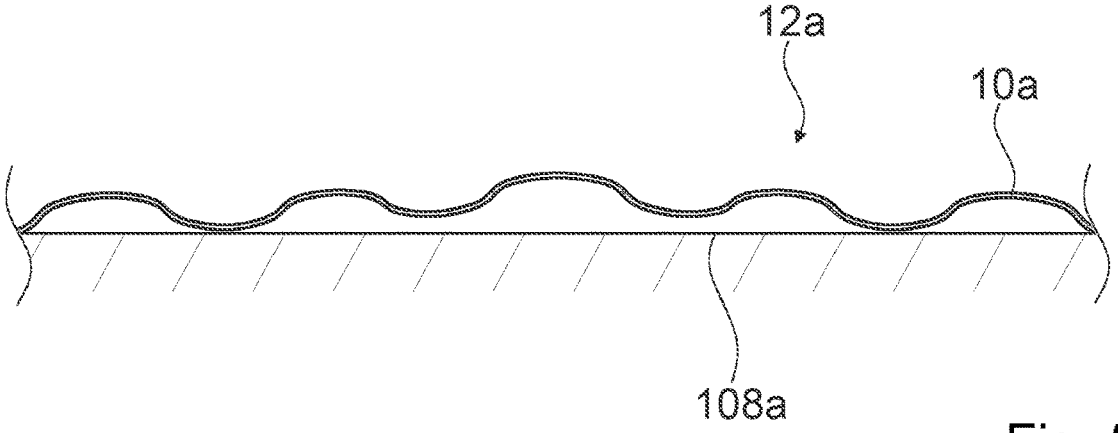
FIG. 5 shows a schematic view of part of the chain-link net, viewed from a direction parallel with the plane of main extent of the chain-link net and perpendicular to the longitudinal direction of the helix of the chain-link net.

FIG. 5 shows a schematic view of part of the chain-link net 12*a* viewed from a direction parallel with the plane of main extent of the chain-link net 12*a* and perpendicular to the longitudinal direction 34*a* of the helix 10*a*. The chain-link net 12*a* is completely spread out on a planar surface 108*a*. The chain-link net 12*a* that is completely spread out on the planar surface 108*a* has an undulation W of more than 2*D. The parameter D herein corresponds to the mean maximum perpendicular spacing 106*a*.

Figure 6:
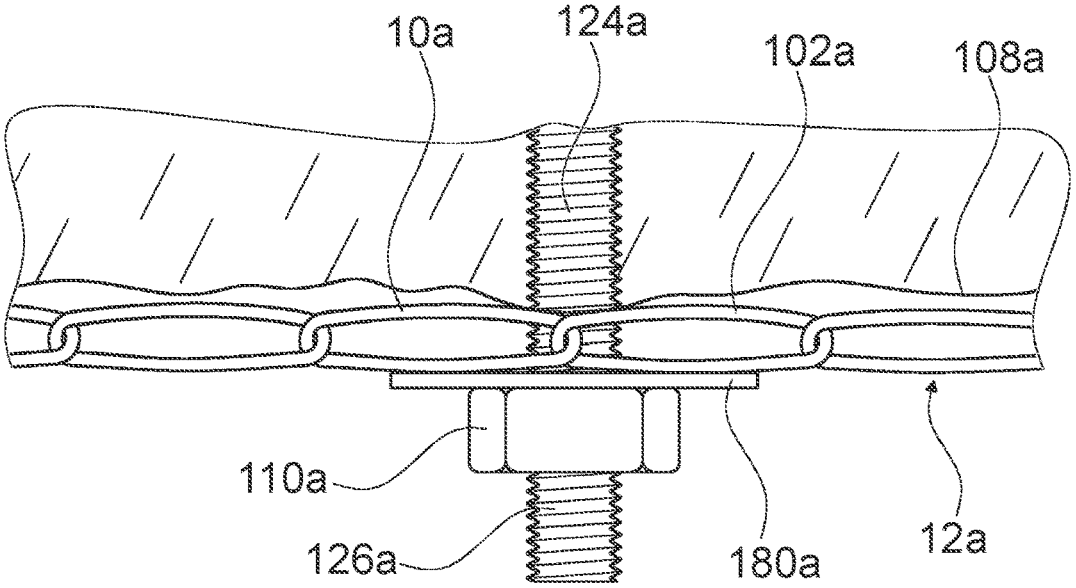
FIG. 6 shows a schematic illustration of a use of the chain-link net for securing in a form-fitting manner an nut.

FIG. 6 shows a schematic illustration of a use of the chain-link net device, in particular of the chain-link net 12*a*, for securing in a force-fitting manner a nut 110*a*. The chain-link net 12*a* bears on a surface 108*a*. A ground anchor 124*a* is incorporated in a hard ground forming the surface 108*a*, for example by drilling.

The ground anchor 124*a* is embodied as a threaded bar having a thread 126*a*. The ground anchor 124*a* is guided through the chain-link net 12*a*. The nut 110*a* for fastening the chain-link net 12*a* relative to the surface 108*a* is screwed onto the ground anchor 124*a*. The nut 110*a* or a flat washer 180*a* of the nut 110*a* has a diameter which is larger than the meshes 116*a* of the chain-link net 12*a*. For fastening the chain-link net 12*a*, the chain-link net 12*a* is jammed between the surface 108*a* and the nut 110*a*. The chain-link net 12*a* is imparted a spring capacity on account of the bulging curvatures 94*a*, 118*a* of the legs 16*a*, 18*a* of the helices 10*a*, 102*a*. The bulging curvatures 94*a*, 118*a* are elastically deformed, that is to say bent counter to a curvature direction, on account of the nut 110*a* being screwed onto the ground anchor 124*a*. On account thereof, the nut 110*a* by the chain-link net 12*a* is pushed in a direction pointing away from the surface 108*a*, on account of which a force-fit between the nut 110*a* and the thread 126*a* of the ground anchor 124*a* is established.

FIG. 7*a* shows a schematic view of a production device 46*a* for producing helices 10*a*, 102*a*. The production device 46*a* has a braiding knife assembly 24*a*. The braiding knife assembly 24*a* comprises a braiding knife 22*a*. The braiding knife 22*a* is configured for winding an initially non-bent longitudinal element 14*a*. The braiding knife assembly 24*a* has a braiding worm 38*a*. The braiding worm 38*a* is configured for guiding the longitudinal element 14*a* that is wound onto the braiding knife 22*a*. The braiding worm 38*a* is largely implemented from a material having a Vickers hardness of more than 600 HV 10. The braiding worm 38*a* comprises at least one worm thread turn 64*a* along which the longitudinal element 14*a* wound onto the braiding knife 22*a* is guided. The worm thread turn 64*a* comprises a plurality of turns. The braiding worm 38*a* in the exemplary embodiment shown in FIG. 7*a* has a single worm thread turn 64*a*. Alternatively, a braiding worm 38'*a* can have a second worm thread turn 64'*a* in order for a production capacity to be increased (cf. FIG. 7*b*).

The braiding knife assembly 24*a* comprises a holding unit 82*a*. The holding unit 82*a* is configured for mounting the braiding worm 38*a* in a rotationally fixed manner. Alternatively, it is conceivable for the holding unit 82*a* to be able to permit and/or generate a rotation of the braiding worm 38*a*, in particular in a rotation direction that is opposite to a rotation direction of the braiding knife 22*a*. The holding unit 82*a* has a braiding worm holding element 128*a*. The braiding worm holding element 128*a* is configured for mounting at least one braiding worm 38*a* in a releasable and locationally fixed manner. It is conceivable for the braiding knife assembly 24*a* to comprise a plurality of braiding worms 38*a* disposed in a row. The holding unit 82*a* has a braiding knife holding element 130*a*. The braiding knife holding element 130*a* is configured for mounting and/or guiding the braiding knife 22*a*. The braiding knife holding element 130*a* comprises a preferably round opening 132*a*, the braiding knife 22*a* being guided within said opening 132*a*. The braiding knife holding element 130*a* in a braiding direction 134*a* of the braiding knife 22*a* is disposed so as to be ahead of an infeed of the longitudinal element 14*a* to the braiding knife 22*a*. The braiding knife assembly 24*a* comprises a drive unit 84*a*. The drive unit 84*a* is configured for generating a rotating movement of the braiding knife 22*a*. The production device 46*a* has an control and/or regulation unit 80*a*. The control and/or regulation unit 80*a* is configured for controlling the drive unit 84*a*. The braiding knife 22*a* is disposed within the braiding worm 38*a*. The braiding knife 22*a* is configured for rotating within the braiding worm 38*a*. The braiding knife assembly 24*a* has a longitudinal element infeed device 136*a*. The longitudinal element infeed device 136*a* is configured for aligning an as yet non-bent longitudinal element 14*a* relative to the braiding knife 22*a* and for feeding said longitudinal element 14*a* to the braiding knife 22*a*.

The production device 46*a* has a rectifying unit 40*a*. The rectifying unit 40*a* is configured for rectifying a helix 10*a*, 102*a* in such a manner that at least the center points 26*a* of the first leg 16*a* of the completely bent helix 10*a*, 102*a* lie in one common plane. The rectifying unit 40*a* is configured for rectifying a helix 10*a*, 102*a* in such a manner that at least the center points 28*a* of the second leg 18*a* of the completely bent helix 10*a*, 102*a* lie in one further common plane. The common plane and the further common plane are preferably free of mutual lines of intersection. A portion 152*a* of the rectifying unit 40*a* is disposed in a region of the braiding knife 22*a*, and a further portion 142*a* of the rectifying unit 40*a* is disposed so as to be downstream of the braiding knife 22*a* and of the braiding worm 38*a*, in particular downstream of the entire braiding knife assembly 24*a*. The rectifying unit 40*a* is configured for overbending helices 10*a*, 102*a* at the bending regions 20*a* thereof. The rectifying unit 40*a* is configured for compensating rebounding of the helices 10*a*, 102*a* in a bending procedure. The rectifying unit 40*a* is configured for setting desired geometries of the helix 10*a*, 102*a*, for example the square mesh shape 32*a*, and/or desired angles of the helix 10*a*, 102*a*, for example the pitch angle 112*a*, the angle α, an opening angle 68*a* of the bending region 20*a*, or the bending angle 100*a* of the bending region 20*a*.

The rectifying unit 40*a* is partly implemented integrally with the braiding worm 38*a*. The braiding worm 38*a* has a turn pitch angle 66*a*. The Turn pitch angle 66*a* of the braiding worm 38*a* that partly implements a rectifying unit 40*a* is smaller than half an opening angle 68*a* of a bending region 20*a* of a helix 10*a*, 102*a* completely bent by the braiding knife 22*a* and by the braiding worm 38*a*. On account thereof, the helix 10*a*, 102*a* is overbent in the longitudinal direction 34*a*. A pitch 70*a* of the worm thread turn 64*a* of the braiding worm 38*a* in the case illustrated is less than 0.9 times half the opening angle 68*a* of the bending region 20*a* of the helix 10*a*, 102*a* completely bent by the braiding knife 22*a* and by the braiding worm 38*a*. The pitch 70*a* of the worm thread turn 64*a* corresponds to the turn pitch angle 66*a*.

FIG. 8*a* shows a schematic view of the braiding knife 22*a*. A wire 30*a* is wound onto the braiding knife 22*a* illustrated. The braiding knife 22*a* is implemented from flat material. The braiding knife 22*a* is realized as a flat steel. The braiding knife 22*a* is implemented integrally. The braiding knife 22*a* is implemented from a material having a Vickers hardness of more than 600 HV 10. The braiding knife 22*a* has a longitudinal axis 48*a*. The braiding knife 22*a* in a braiding operation is configured for rotating around the longitudinal axis 48*a*. The braiding knife 22*a* has a section 138*a* along which the braiding knife 22*a* is helically twisted along the longitudinal axis 48*a* of the braiding knife 22*a*. The helically twisted section 138*a* of the braiding knife 22*a* is twisted by an angle α. The angle α is more than 45°. The angle α in the exemplary embodiment shown is 60° (cf. FIG. 8*b*). The angle α herein can correspond to an equation α(1−r)*180°, wherein r is a rebound factor of the helices 10*a*, 102*a* implemented from high-tensile steel. The braiding knife 22*a* is twisted by at least 10° in a region 50*a* across which a spiral turn 140*a* of the helix 10*a*, 102*a* extends when bending a helix 10*a*, 102*a*. A "spiral turn" 140*a* of the helix 10*a*, 102*a* is in particular to be understood as a complete 360° turn of the helix 10*a*. 102*a*.

The rectifying unit 40*a* is partly implemented integrally with the braiding knife 22*a*. The twisted section 138*a* of the braiding knife 22*a* is configured for rectifying the helix 10*a*, 102*a*, in particular the bending angle 100*a* of the helix 10*a*, 102*a*. The twisted section 138*a* of the braiding knife 22*a* is configured for overbending the helix 10*a*, 102*a*, in particular the bending angle 100*a* of the helix 10*a*, 102*a*. The braiding knife 22*a* is in particular configured for overbending the helix 10*a*, 102*a*, by an overbending angle 36*a* (cf. FIG. 8*c*). The overbending angle 36*a* generated by the braiding knife 22*a* corresponds in particular to an angle by way of which the braiding knife 22*a* is twisted on that half of the region 50*a* across which a spiral turn 140*a* of the helix 10*a*, 102*a* extends when bending a helix 10*a*, 102*a*. The overbending angle 36*a* required for bending a longitudinal element 14*a* from high-tensile steel by 180° is more than 20°.

FIG. 8*c* for explaining the overbending angle 36*a* shows a bending procedure of a wire piece 174*a*, 174'*a*, 174"*a* from high-tensile steel. A non-bent straight wire piece 174*a* is illustrated with hatched lines. The wire piece 174'*a* provided with a complete bend 176*a* is illustrated by a solid line. The completely bent wire piece 174'a has a bend 176a having a bending angle 178a. The wire piece 174a has to be overbent in order for the bending angle 178a to be reached. The overbent wire piece 174"a is illustrated by a dashed line. The wire piece 174a after the overbending springs back by the overbending angle 36a. In order for the wire piece 174'a having the bend 176a to be obtained, that is to say in order for the bending angle 178a to be reached, the wire piece 174a accordingly has to be bent by the bending angle 178a and by the overbending angle 36a.

FIG. 9 shows a schematic perpendicular section through the braiding knife 22a at a non-twisted location of the braiding knife 22a. The braiding knife 22a has a long side 144a, and a further long side 146a that lies opposite the long side 144a. The braiding knife 22a has two narrow sides 148a, 150a that connect the long sides 144a, 146a. The cross section 54a of the braiding knife 22 comprises at least one semicircle. The semicircle is disposed on the narrow side 148a. The cross section 54a of the braiding knife 22a comprises at least one further semicircle. The further semicircle is disposed on the further narrow side 148a that lies opposite the narrow side 148a. Moreover, the cross section 54 of the braiding knife 22a on the narrow sides 148a, 150a comprises partial circles which are larger than semicircles. The cross section 54a of the braiding knife 22a on a first lateral face 56a has a concave curvature 62a. The first lateral face 56a is disposed on the long side 144a of the braiding knife 22a. The cross section 54a of the braiding knife 22a on a second lateral face 58a that lies opposite the first lateral face 56a has a concave curvature 62a. The second lateral face 58a is disposed on the further long side 146a of the braiding knife 22a. The concave curvatures 62a of the braiding knife 22a are disposed at a non-twisted location of the braiding knife 22a. Alternatively or additionally, it is conceivable for the braiding knife 22a to have a concave curvature 62a at a non-twisted location. The concave curvature 62a during a production procedure is configured for permitting overbending of the legs 16a, 18a of the helices 10a, 102a by pressing the helix 10a, 102a into a clearance of the concave curvature 62a.

An extent of an inward curvature of the concave curvature 62a of the braiding knife 22a is capable of being set and/or adjusted. The braiding knife 22a has surface elements 86a. The surface elements 86a are capable of being releasably fastened to the braiding knife 22a, in particular in the region of the concave curvature 62a of the braiding knife 22a. The surface elements 86a are replaceable. The shape of the braiding knife 22a in the region of the concave curvature 62a and/or a depth of the concave curvature 62a of the braiding knife 22a can be established by replacing the surface elements 86a. Alternatively, it is conceivable for the surface elements 86a per se to be variable in terms of their shape, or the spacing of said surface elements 86a from a center of the braiding knife 22a to be capable of being set. For example, a potential overbending angle 36a can be set by assembling suitable surface elements 86a. For example, a concave curvature 62a can be converted to a convex curvature 60a by assembling suitable surface elements 86a, in particular in the case of an increased curvature radius 96a of legs 16a, 18a of helices 10a, 102a being desired or intended. Accordingly, it is conceivable that an extent of a curvature of a convex curvature 60a (cf. also FIG. 16) of the braiding knife 22a may be capable of being set and/or adjusted.

FIG. 10 shows a schematic perpendicular section through the braiding knife 22a at a location of the braiding knife 22a having a concave curvature 62a, and a schematic perpendicular section through a portion 152a of the rectifying unit 40a that is disposed in the region of the braiding knife 22a. The rectifying unit 40a has a pressing device 74a. The pressing device 74a is configured for at least partially rectifying a helix 10a, 102a by pressing said helix against the braiding knife 22a. The pressing device 74a has a first pressing element 76a. The pressing device 74a has a second pressing element 154a. The pressing elements 76a, 154a are configured for pressing a helix 10a, 102a that is wound onto the braiding knife 22a against the braiding knife 22a. The pressing elements 76a, 154a are configured for pressing the helix 10a, 102a that is wound onto the braiding knife 22a against the braiding knife 22a at least in the transition regions 42a, 44a of the helix 10a, 102a. The pressing elements 76a, 154a are disposed on opposite sides of the braiding knife 22a. The pressing elements 76a, 154a are configured for pressing in the manner of pincers the respective legs 16a, 18a of the helices 10a, 102a against the braiding knife 22a. The pressing elements 76a, 154a are configured for mutually compressing the legs 16a, 18a of the helices 10a, 102a. The pressing device 74a illustrated in FIG. 10 has two pairs of pressing elements 76a, 154a which are configured for pressing the transition regions 42a, 44a of different bending regions 20a that are successive along a helical shape of the helices 10a, 102a against the braiding knife 22a. Further additional pairs of pressing elements 76a, 154a are conceivable.

The pressing elements 76a, 154a are movably mounted. The pressing elements 76a, 154a by means of the movable mounting are configured for following a movement of the helices 10a, 102a along the braiding knife 22a at least section-wise. The pressing elements 76a, 154a by means of the movable mounting are configured for following a rotating movement of the braiding knife 22a at least section-wise. The pressing elements 76a, 154a by means of the movable mounting are configured for following a rotating movement and a translatory movement, in particular a helical path, of the helices 10a, 102a on the braiding knife 22a at least section-wise. The pressing elements 76a, 154a are configured for exerting brief contact pressure pulses that are in particular repeated multiple times on the transition regions 42a, 44a of the helices 10a, 102a.

FIG. 11 shows a schematic view of the further portion 142a of the rectifying unit 40a that is disposed downstream of the braiding knife 22a. The portion 142a of the rectifying unit 40a that is disposed downstream has two counter-rotatable rectifying elements 78a, 90a. The counter-rotatable rectifying elements 78a, 90a are configured for rectifying the helices 10a, 102a by overbending the bending regions 20a. The rectifying elements 78a, 90a by rotating neighboring rectifying elements 78a, 90a in opposite directions around a central longitudinal axis 92a of a helix 10a are configured for overbending at least sub-regions of the helix 10a, 102a. Neighboring rectifying elements 78a, 90a are configured for firmly holding neighboring legs 16a, 18a of helices 10a, 102a, for example by jamming, and for subsequently rotating the neighboring legs 16a, 18a in opposite directions to one another until a required overbending angle 36a is reached, and for thereafter releasing said neighboring legs 16a, 18a. It is conceivable for the rectifying unit 40a to have a multiplicity of rectifying elements 78a, 90a disposed in a row. The total number of rectifying elements 78a, 90a of the rectifying unit 40a is advantageously equal to the total number of bending regions 20a of the helix 10a, 102a plus one. The production device 46a has a further drive unit 88a. The further drive unit 88a is configured for generating the rotation in opposite directions and/or the longitudinal displacement of the rectifying elements 78*a*, 90*a* in opposite directions. The control and/or regulation unit 80*a* is configured for controlling the further drive unit 88*a*.

Alternatively or additionally, the rectifying elements 78*a*, 90*a* of the rectifying unit 40*a* are longitudinally displaceable in opposite directions that run so as to be parallel with the longitudinal axis 48*a* of the braiding knife 22*a*. The longitudinally displaceable rectifying elements 78*a*, 90*a* are configured for pulling apart sub-regions of helices 10*a*, 102*a* in the longitudinal direction 34*a* of the helices 10*a*, 102*a*. The longitudinally displaceable rectifying elements 78*a*, 90*a* are configured for setting opening angles 68*a* of bending regions 20*a* of helices 10*a*, 102*a* by overbending bending regions 20*a*. Neighboring rectifying elements 78*a*, 90*a* are configured for firmly holding neighboring legs 16*a*, 18*a* of helices 10*a*, 102*a*, for example by jamming, and for subsequently pulling apart neighboring legs 16*a*, 18*a* until a required overbending angle 36*a* is reached, and for subsequently releasing said legs 16*a*, 18*a*. Alternatively, it is conceivable for part of the helix 10*a*, 102*a* that comprises a plurality of bending regions 20*a*, or for the entire helix 10*a*, 102*a* to be pulled apart by two longitudinally displaceable rectifying elements 78*a*, 90*a*. Moreover, it is conceivable for the longitudinally displaceable rectifying elements 78*a*, 90*a* to be used for subsequently compressing the helix 10*a*, 102*a* and for a resultant reduction of the opening angle 68*a* of bending regions 20*a*.

FIG. 12 shows a sequence diagram of a method for producing the helices 10*a*, 102*a* of the chain-link net 12*a*. In at least one method step 156*a*, a longitudinal element 14*a* is unwound from a bobbin and by way of the longitudinal element infeed device 136*a* is fed to the braiding knife 22*a*. In at least one further method step 158*a*, the longitudinal element 14*a* by the combination of the braiding knife 22*a* and the braiding worm 38*a* is bent so as to form a helix 10*a*, 102*a*. In the method step 158*a*, the longitudinal elements 14*a* by the braiding knife assembly 24*a* comprising the braiding knife 22*a* are bent so as to form helices 10*a*, 102*a* in such a manner that at least the center points 26*a* of the first legs 16*a* created in the bending procedure, and/or at least the center points 28*a* of the second legs 18*a* created in the bending procedure of a completely bent helix 10*a*, 102*a* lie respectively at least substantially in one plane. In the method step 158*a*, the longitudinal elements 14*a* are bent so as to form helices 10*a*, 102*a* in such a manner that the chain-link net 12*a* is formed when conjointly plying a plurality of completely bent helices 10*a*, 102*a*, said chain-link net 12*a* in the frontal view perpendicular to the plane of main extent of the helices 10*a*, 102*a* realizing the square mesh shape 32*a*. In the method step 158*a*, the helices 10*a*, 102*a* by the braiding knife assembly 24*a* are bent in such a manner that rebounding of the wire 30*a* of the helices 10*a*, 102*a* that is made of high-tensile steel is compensated for in particular in a direction transverse to the longitudinal direction 34*a* of the helices 10*a*, 102*a*. In the method step 158*a*, the helices 10*a*, 102*a* by the braiding knife assembly 24*a* are moreover overbent in a direction transverse to the longitudinal direction 34*a* of the helices 10*a*, 102*a*. In the method step 158*a*, the helices 10*a*, 102*a* by the braiding knife assembly 24*a* can additionally be overbent in a direction parallel with the longitudinal direction 34*a* of the helix 10*a*.

In at least one method sub-step 160*a* of the method step 158*a*, the rebound of the longitudinal element 14*a* that arises in a bending procedure is partially compensated for by the braiding knife 22*a*. In the method sub-step 160*a* of the method step 158*a*, the longitudinal element 14*a*, in particular the helix 10*a*, 102*a*, is overbent by the braiding knife 22*a*. In at least one further method sub-step 162*a* of the method step 158*a*, the rebound of the longitudinal element 14*a* that arises in a bending procedure is partially compensated for by the braiding worm 38*a*. In the further method sub-step 162*a* of the method step 158*a*, the longitudinal element 14*a*, in particular the helix 10*a*, 102*a*, is overbent by the braiding worm 38*a*. In at least one further method sub-step 164*a* of the method step 158*a*, the rebound that arises in a bending procedure is partially compensated for by the rectifying unit 40*a* that is downstream of the braiding knife 22*a*. In the further method sub-step 164*a* of the method step 158*a*, the longitudinal element 14*a*, in particular the helix 10*a*, 102*a*, is overbent by the rectifying unit 40*a* that is downstream of the braiding knife 22*a*. In the further method sub-step 164*a* of the method step 158*a*, the helices 10*a*, 102*a* for rectifying the helices 10*a*, 102*a*, in addition to the bending procedure caused by the braiding knife 22*a* are elongated parallel with the longitudinal direction 34*a* of the helices 10*a*, in addition to the bending procedure caused by the braiding knife 22*a* are compressed parallel with the longitudinal direction 34*a* of the helices 10*a*, 102*a* and/or in addition to the bending procedure caused by the braiding knife 22*a* are turned transversely to the longitudinal direction 34*a* of the helices 10*a*, 102*a*.

In at least one further method step 166*a* which can in particular also be a method sub-step of the method step 158*a*, the respective longitudinal element 14*a* bearing on the braiding knife 22, in particular the respective helix 10*a*, 102*a* bearing on the braiding knife 22*a*, during the bending procedure is pressed against the braiding knife 22*a* at least in the transition region 42*a* and/or at least in the further transition region 44*a*. In at least one of or else both method steps 158*a*, 166*a*, the longitudinal elements 14*a*, in particular the helices 10*a*, 102*a* are overbent by an overbending angle 36*a* of at least 20°.

FIG. 12*b* in an exemplary manner shows a helix 10*a* from a high-tensile wire 30*a*, said helix not having been rectified, in particular not rectified in a planar manner, viewed in parallel with the longitudinal direction 34*a* of the helix 10*b*. The individual legs 16*a*, 18*a* of the helix, the center points 26*a*, 28*a* of said legs 16*a*, 18*a*, as well as the bending regions 20*a* of the helix, do not lie in one plane but are in respectively offset by an offset angle 182*a*. The claimed method and the claimed production device 46*a* are configured for minimising the offset angle 182*a* and for preferably not permitting any offset angle 182*a*.

Six further exemplary embodiments of the invention are shown in FIGS. 13 to 18. The descriptions hereunder and the drawings are substantially limited to the points of differentiation between the exemplary embodiments, wherein reference can in principle be made also to the drawings and/or the description of the other exemplary embodiments, in particular those of FIGS. 1 to 12*b*, in terms of components with identical identification, in particular in terms of components having identical reference numerals. In order for the exemplary embodiments to be differentiated, the suffix a is applied to the reference numerals of the exemplary embodiment in FIGS. 1 to 12*b*. The suffix a is replaced by b to g in the exemplary embodiments of FIGS. 13 to 18.

FIG. 13 shows a schematic view of an alternative chain-link net 12*b* viewed in a direction parallel with a plane of main extent of the chain-link net 12*b* and parallel with a longitudinal direction 34*b* of a helix 10*b*, 102*b* of the chain-link net 12*b*. The chain-link net 12*b* comprises at least the helix 10*b* and at least the further helix 102*b*. The helices 10*b*, 102*b* comprise first legs 16*b*, second legs 18*b*, and bending regions 20*b* that connect the legs 16*b*, 18*b*. The legs

16*b*, 18*b* of the helices 10*b*, 102*b* have bulging curvatures 94*b*, 118*b*. The bulging curvatures 94*b*, 118*b* of the legs 16*b*, 18*b* of the helix 10*b* have a curvature radius 96*b*, 120*b*. The legs 16*b*, 18*b* of the further helix 102*b* have a further curvature radius 168*b*. The curvature radii 96*b*, 120*b* of the bulging curvatures 94*b*, 118*b* of the helix 10*b* of the chain-link net 12*b* vary substantially in relation to the curvature radii 168*b* of the bulging curvatures 94*b*, 118*b* of the further helix 102*b* of the chain-link net 12*b*. The curvature radii 96*b*, 120*b* of the bulging curvatures 94*b*, 118*b* of the helix 10*b* are substantially smaller than the curvature radii 168*b* of the bulging curvatures 94*b*, 118*b* of the further helix 102*b* of the chain-link net 12*b*. The curvature radii 96*b*, 120*b* of the bulging curvatures 94*b*, 118*b* of the helix 10*b* of the chain-link net 12*b* are more than 30% smaller than the curvature radii 168*b* of the bulging curvatures 94*b*, 118*b* of the further helix 102*b* of the chain-link net 12*b*.

FIG. 14 shows an alternative production device 46*c* having a braiding knife assembly 24*c* having an alternative braiding knife 22*c*. The braiding knife 22*c* has a section 138*c* along which the braiding knife 22*c* is helically twisted along a longitudinal axis 48*c* of the braiding knife 22*c*. The braiding knife 22*c* is twisted multiple times in the section 138*c*. The twist of the braiding knife 22*c* in the section 138*c* is more than 360°.

FIG. 15 shows a further alternative production device 46*d* having a further alternative braiding knife assembly 24*d* having a further alternative braiding knife 22*d*. The braiding knife assembly 24*d* is configured for bending a helix 10*d*, 102*d* from a longitudinal element 14*d*. The braiding knife 22*d* has a section 138*d* along which the braiding knife 22*d* is helically twisted along a longitudinal axis 48*d* of the braiding knife 22*d*. The braiding knife 22*d* has an outlet 170*d*. The completely bent longitudinal element 14*d* exits the braiding knife 22*d* at the outlet 170*d*. The helical twist of the braiding knife 22*d* has a pitch 52*d*, 52'*d*. The pitch 52*d*, 52'*d* of the helical twist of the braiding knife 22*d* increases toward the outlet 170*d* along the longitudinal axis 48*d* of the braiding knife 22*d*. Alternatively, it is conceivable for the pitch 52*d*, 52'*d* of the twist of the braiding knife 22*d* to decrease toward the outlet 170*d* of the braiding knife 22*d* along the longitudinal axis 48*d*.

FIG. 16 shows a second further alternative production device 46*e* having a second further alternative braiding knife assembly 24*e* having a second further alternative braiding knife 22*e*. The braiding knife 22*e* has a cross section 54*e*, the shape thereof having a convex curvature 60*e* at least on a first lateral face 56*e* of the cross section 54*e*. Moreover, the shape of the cross section 54*e* of the braiding knife 22*e* on a second lateral face 58*e* of the cross section 54*e* that lies opposite the first lateral face 56*e* of the cross section 54*e* has a convex curvature 60*e*.

FIG. 17 shows a third further alternative production device 46*f* having a third further alternative braiding knife assembly 24*f* having an alternative braiding worm 38*f*. The braiding knife assembly 24*f* is configured for bending a helix 10*f*, 102*f* from a longitudinal element 14*f*. The braiding worm 38*f* has an outlet 72*f*. The completely bent longitudinal element 14*f* exits the braiding worm 38*f* at the outlet 72*f*. The braiding worm 38*f* has a worm thread turn 64*f*. The worm thread turn 64*f* has a variable turn pitch angle 66*f*. A size of the turn pitch angle 66*f* of the worm thread turn 64*f* decreases toward an outlet 72*f* of the braiding worm 38*f*.

FIG. 18 shows part of a fourth alternative production device 46*g* having an alternative rectifying unit 40*g*. A schematic sectional view of a section through a braiding knife 22*g* of a braiding knife assembly 24*g* of the production device 46 as well as through an alternative pressing device 74*g* of the alternative rectifying unit 40*g* is shown in FIG. 18. The rectifying unit 40*g* has the pressing device 74*g*. The pressing device 74*g* has pressing elements 76*g*, 154*g*. The external shape of the pressing element 76*g*, 154*g* is adapted to an external shape of the braiding knife 22*g*. The external shape of the braiding knife 22*g* has a concave curvature 62*g*.

The pressing elements 76*g*, 154*g* are adapted to the concave curvature 62*g*. The pressing elements 76*g*, 154*g* have a convex curvature 172*g*. The convex curvature 172*g* of the pressing elements 76*g*, 154*g* in a rectifying procedure, in particular in an overbending procedure, is configured for engaging in the concave curvature 62*g* of the braiding knife 22*g* and, on account thereof, for overbending and/or rectifying, in particular rectifying in a planar manner, a longitudinal element 14*g* bent to a helical shape by the braiding knife assembly 24*g*. Alternatively, it is conceivable for the pressing elements 76*g*, 154*g* to be adapted to a convex curvature 60*g* of a braiding knife 22*g*. Moreover, it is conceivable for the external shape of the pressing elements 76*g*, 154*g* to be adapted to a helical shape of a twist of a braiding knife 22*g* twisted at least section-wise. The external shape of the pressing elements 76*g*, 154*g* is realized so as to be complementary to at least one section of the braiding knife 22*g*.

LIST OF REFERENCE NUMERALS

10 Helix
12 Chain-link net
14 Longitudinal element
16 First leg
18 Second leg
20 Bending region
22 Braiding knife
24 Braiding knife assembly
26 Centre point
28 Centre point
30 Wire
32 Square mesh shape
34 Longitudinal direction
36 Overbending angle
38 Braiding worm
40 Rectifying unit
42 Transition region
44 Further transition region
46 Production device
48 Longitudinal axis
50 Region
52 Pitch
54 Cross section
56 First lateral face
58 Second lateral face
60 Convex curvature
62 Concave curvature
64 Worm thread turn
66 Turn pitch angle
68 Opening angle
70 Pitch
72 Outlet
74 Pressing device
76 Pressing element
78 Rectifying element
80 Control and/or regulation unit
82 Holding unit
84 Drive unit
86 Surface element

88 Further drive unit
90 Rectifying element
92 Central longitudinal axis
94 Bulging curvature
96 Curvature radius
98 Edge length
100 Bending angle
102 Further helix
104 Diameter
106 Spacing
108 Surface
110 Nut
112 Pitch angle
114 Frontal direction
116 Mesh
118 Bulging curvature
120 Curvature radius
122 S-shape
124 Ground anchor
126 Thread
128 Braiding worm holding element
130 Braiding knife holding element
132 Opening
134 Braiding direction
136 Longitudinal element infeed device
138 Section
140 Spiral turn
142 Further portion
144 Long side
146 Further long side
148 Narrow side
150 Narrow side
152 Portion
154 Pressing element
156 Method step
158 Method step
160 Method sub-step
162 Method sub-step
164 Method sub-step
166 Method step
168 Curvature radius
170 Outlet
172 Convex curvature
174 Wire piece
176 Bend
178 Bending angle
180 Washer
182 Offset angle

The invention claimed is:

1. A chain-link net, comprising a plurality of interconnected helices, which are rotated into one another, and of which at least one helix is produced from at least one longitudinal element with at least one wire that is at least partially implemented from a high-tensile steel, and comprises at least one first leg, at least one second leg, as well as at least one bending region that interconnects the first leg and the second leg, wherein connected helices, in a frontal view perpendicular to a plane of main extent of the helices, realize a square mesh shape, wherein the legs of the interconnected helices in a transverse view parallel with the plane of main extent of the helices are outwardly curved in a bulging manner, wherein a bulging curvature of the legs of the interconnected helices in the transverse view have a curvature radius of at least 3 cm and of at most 50 cm so that the chain-link net is imparted with a spring capacity on account of the bulging curvatures of the legs of the helices of the chain-link net, and/or wherein a curvature radius of the bulging curvature of at least one helix of the plurality of helices varies substantially in relation to at least one further helix of the plurality of helices.

2. The chain-link net device according to claim 1, wherein the square mesh shape has an edge length of at least 3 cm.

3. The chain-link net device according to claim 1, wherein the square mesh shape has an edge length of at most 20 cm.

4. The chain-link net device according to claim 1, wherein the helix in the bending region is bent by a bending angle of less than 180°.

5. The chain-link net device according to claim 1, wherein the helix in the bending region is bent by a bending angle of more than 145°.

6. The chain-link net device according to claim 1, wherein the longitudinal element composed of the high-tensile steel wire has a diameter of at least 2 mm and at most 6 mm.

7. The chain-link net device according to claim 1, wherein a mean maximum perpendicular spacing of two bulgingly curved legs of a helix that are interconnected by a bending region is at least 4 times a diameter of the longitudinal element of the helix.

8. The chain-link net device according to claim 1, wherein a chain-link net that is realized by the connected helices and is completely spread out on a planar surface has an undulation W of at least 2*D, wherein the parameter D, viewed in the transverse view of the helices of the chain-link net, corresponds to a mean maximum perpendicular spacing of two legs of a helix of the chain-link net that are interconnected by a bending region.

9. A use of a chain-link net device according to claim 1 for trapping and/or retaining rocks in mining, in slope stabilization, in rockfall and/or avalanche protection, and/or for trapping vehicles in motor sports or for counter-terrorism and/or for securing a nut in a force-fitting manner.

* * * * *